United States Patent [19]

Nakamine et al.

[11] Patent Number: 5,017,454

[45] Date of Patent: May 21, 1991

[54] HEAT-DEVELOPABLE COLOR LIGHT-SENSITIVE MATERIAL

[75] Inventors: Takeshi Nakamine; Ken Kawata; Toshiki Taguchi, all of Kanagawa, Japan

[73] Assignee: Fuji Photo Film Co., Ltd., Kanagawa, Japan

[21] Appl. No.: 394,983

[22] Filed: Aug. 17, 1989

[30] Foreign Application Priority Data

Aug. 17, 1988 [JP] Japan ..... 63-204424

[51] Int. Cl.[5] ..... G03C 5/54; G03C 7/26; G03C 5/30

[52] U.S. Cl. ..... 430/203; 430/218; 430/223; 430/440; 430/483; 430/559

[58] Field of Search ..... 430/203, 218, 223, 559, 430/440, 483

[56] References Cited

U.S. PATENT DOCUMENTS

| | | | |
|---|---|---|---|
| 4,463,081 | 7/1984 | Michno | 430/218 |
| 4,471,045 | 9/1984 | Bodem et al. | 430/218 |
| 4,559,290 | 12/1985 | Sawada et al. | 430/203 |
| 4,783,396 | 11/1988 | Nakamura et al. | 430/203 |

*Primary Examiner*—Richard L. Schilling
*Attorney, Agent, or Firm*—Sughrue, Mion, Zinn Macpeak & Seas

[57] ABSTRACT

A heat-developable color light sensitive material comprising a support having thereon at least a light-sensitive silver halide, a binder, a non-diffusible compound capable of releasing a diffusible dye upon reduction, an electron donor compound and an electron transfer agent, said electron transfer agent being represented by formula (I):

(I)

wherein $R_1$, $R_2$, $R_3$ and $R_4$, which may be the same or different, each represents hydrogen, a substituted or unsubstituted alkyl group, or a substituted or unsubstituted aryl group; $R_5$ represents a halogen atom, a hydroxyl group, a substituted or unsubstituted alkyl group, or a substituted or unsubstituted alkoxy group; $R_6$, $R_7$, $R_8$ and $R_9$, which may be the same or different, each represents hydrogen, a halogen atom, a hydroxyl group, a carboxyl group, a substituted or unsubstituted alkyl group, a substituted or unsubstituted aryl group, a substituted or unsubstituted alkoxy group, a substituted or unsubstituted amino group, a substituted or unsubstituted acyl group, a substituted or unsubstituted alkoxycarbonyl group, a substituted or unsubstituted acyloxy group, a substituted or unsubstituted carbamoyl group, a substituted or unsubstituted acylamino group, a substituted or unsubstituted sulfamoyl group, a substituted or unsubstituted sulfonamido group, a substituted or unsubstituted urethane group, a substituted or unsubstituted ureido group. The heat-developable color light-sensitive material provides an image having a superior S/N ratio and improved preservability over time.

19 Claims, No Drawings

HEAT-DEVELOPABLE COLOR LIGHT-SENSITIVE MATERIAL

FIELD OF THE INVENTION

The present invention relates to a heat-developable color light-sensitive material, more particularly, a heat-developable color light-sensitive material which is excellent in preservability over time, providing positive color images having an improved S/N ratio.

BACKGROUND OF THE INVENTION

Heat-developable light-sensitive materials are well known in the art. Examples of heat-developable light-sensitive materials and heat development processes are described, for example, in *Shashinkoqaku no Kiso,* "Edition of Higin-en Shashin", pages 242 to 255 (Corona Co., Ltd., 1982) and U.S. Pat. No. 4,500,626.

With respect to processes for obtaining positive color images many methods have been proposed. For instance, in U.S. Pat. No. 4,559,290, a method is described where an oxidized compound, which in its oxidized state does not have a dye releasing ability, obtained by converting a so-called DRR compound, is present with a reducing agent, the reducing agent is oxidized by exposed silver halide upon heat development, and the oxidized compound is reduced with the remaining reducing agent which is not oxidized, whereby a diffusible dye is released. Further, in European Patent Application (OPI) No. 220,746 and *Kokai Giho* 87-6199 (*Kokai Giho,* Vol. 12, No. 22), a method of forming a heat-developable positive image using a novel compound which can release a diffusible dye by a similar mechanism is described.

In the process of forming positive images using the reducible dye providing compound as described above, an electron donor and an electron transfer agent are ordinarily employed together as reducing agents.

It is known that 1-phenyl-3-pyrazolidinone derivatives which are known developing agents are effective as electron transfer agents (ETA) used in such a system. However, when a 1-phenyl-3-pyrazolidinone derivative, for example, 1-phenyl-3-pyrazolidinone or 4-methyl-4'-hydroxymethyl-1-phenyl-3-pyrazolidinone is employed as an electron transfer agent, it has been found problems occur such as increase in stain and degradation of an S/N ratio of image after storage, since the electron transfer agent is unstable and gradually decomposes and disappears during storage.

SUMMARY OF THE INVENTION

Therefore, an object of the present invention is to improve preservability and S/N ratio of a heat-developable color light-sensitive material containing a reducible dye providing compound.

Other objects of the present invention will become apparent from the following detailed description and examples.

It has now been found that these objects of the present invention are accomplished with a heat-developable color light-sensitive material comprising a support having thereon at least a light-sensitive silver halide, a binder, a non-diffusible dye providing compound capable of releasing a diffusible dye upon reduction, an electron donor and an electron transfer agent, wherein the electron transfer agent is a compound represented by formula (I):

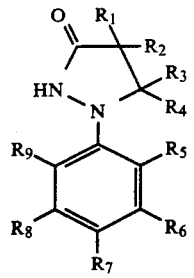

(I)

wherein $R_1$, $R_2$, $R_3$ and $R_4$, which may be the same or different, each represents hydrogen, a substituted or unsubstituted alkyl group, or a substituted or unsubstituted aryl group; $R_5$ represents a halogen atom, a hydroxyl group, a substituted or unsubstituted alkyl group, or a substituted or unsubstituted alkoxy group; $R_6$, $R_7$, $R_8$ and $R_9$, which may be the same or different, each represents hydrogen, a halogen atom, a hydroxyl group, a carboxyl group, a subsituted or unsubstituted alkyl group, a substituted or unsubstituted aryl group, a substituted or unsubstituted alkoxy group, a substituted or unsubstituted amino group, a substituted or unsubstituted acyl group, a substituted or unsubstituted alkoxycarbonyl group, a substituted or unsubstituted acyloxy group, a substituted or unsubstituted carbamoyl group, a substituted or unsubstituted acylamino group, a subsituted or unsubstituted sulfamoyl group, a substituted or unsubstituted sulfonamido group, a substituted or unsubstituted urethane group, or a substituted or unsubstituted ureido group.

DETAILED DESCRIPTION OF THE INVENTION

In the electron transfer agent represented by formula (1), $R_1$, $R_2$, $R_3$ and $R_4$, which may be the same or different, each represents hydrogen, a substituted or unsubstituted alkyl group (for example, methyl, ethyl, or cyclohexyl) or substituted or unsubstituted aryl group (for example, phenyl). Suitable examples of the substituent include a halogen atom (for example, fluorine, chlorine, or bromine), a hydroxyl group, a substituted or unsubstituted alkoxy group (for example, methoxy, ethoxy, methoxyethoxy, or tetrahydropyran-2-oxy), a substituted or unsubstituted alkoxycarbonyl group (for example, methoxycarbonyl, or phenoxycarbonyl), a substituted or unsubstituted acyloxy group (for example, acetoxy, or benzoyloxy), a substituted or unsubstituted amino group (for example, amino, methylamino, or dimethylamino), a substituted or unsubstituted carbamoyl group (for example, ethylcarbamoyl, or dimethylcarbamoyl), and a substituted or unsubstituted acylamino group (for example, acetylamino, or benzoylamino).

$R_5$ represents a halogen atom (for example, fluorine, chlorine, or bromine), a hydroxyl group, a substituted or unsubstituted alkyl group (for example, methyl, or ethyl) or a substituted or unsubstituted alkoxy group (for example, methoxy, or ethoxy). For $R_5$, a methyl group or a methoxy group is preferred.

$R_6$, $R_7$, $R_8$ and $R_9$, which may be the same or different, each represents hydrogen, a halogen atom (for example, fluorine, chlorine, or bromine), a hydroxyl group, a carboxyl group, a substituted or unsubstituted alkyl group (for example, methyl, or 2-hydroxyethyl), a substituted or unsubstituted aryl group (for example, phenyl), a substituted or unsubstituted alkoxy group (for example, methoxy, ethoxy, or methoxyethoxy), a substituted or unsubstituted amino group (for example, amino, methylamino, or dimethylamino), a substituted or unsubstituted acyl group (for example, acetyl, or benzoyl), a substituted or unsubstituted alkoxycarbonyl group (for example, methoxycarbonyl, or phenoxycarbonyl), a substituted or unsubstituted acyloxy group (for example, acetoxy, or benzoyloxy), a substituted or unsubstituted carbamoyl group (for example, methylcarbamoyl, or dimethylcarbamoyl), a substituted or unsubstituted acylamino group (for example, acetylamino, or benzoylamino), a substituted or unsubstituted sulfamoyl group (for example, methylsulfamoyl), a substituted or unsubstituted sulfonamido group (for example, methanesulfonamido), a substituted or unsubstituted urethane group (for example, phenylurethane, dimethylurethane), or a substituted or unsubstituted ureido group (for example, phenylureido, or dimethylureido).

It is preferred that at least one of $R_6$, $R_7$ and $R_8$ represents an electron donative group (for example, an alkyl group, an alkoxy group, or an amino group).

For $R_9$, hydrogen is particularly preferred.

Preferred specific examples of the compound represented by formula (I) are set forth below, but the present invention is not to be construed as being limited thereto.

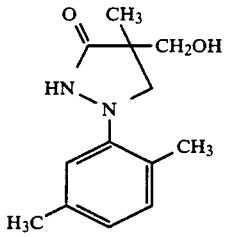
(X-1)

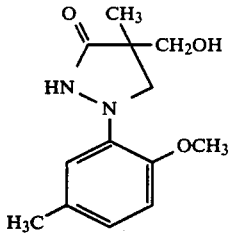
(X-2)

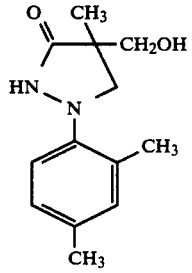
(X-3)

-continued

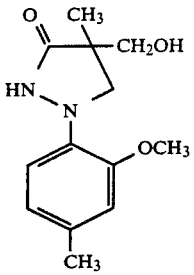
(X-4)

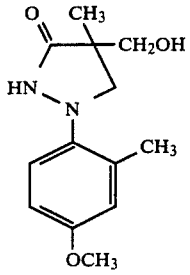
(X-5)

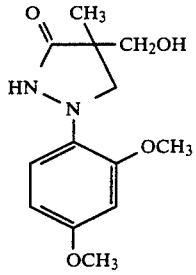
(X-6)

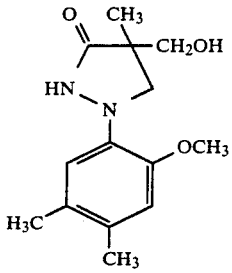
(X-7)

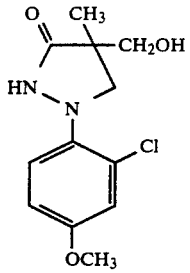
(X-8)

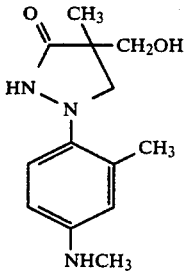
(X-9)

-continued
(X-10)
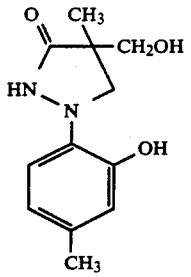
(X-11)
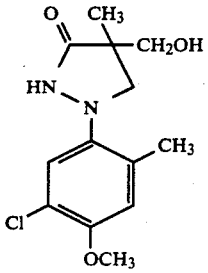
(X-12)
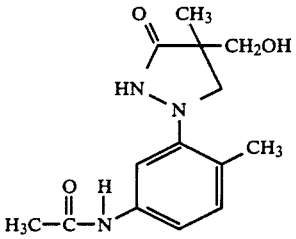
(X-13)
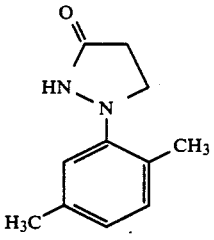
(X-14)
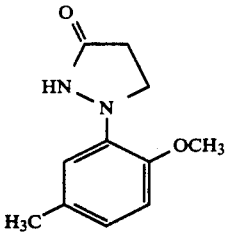
(X-15)
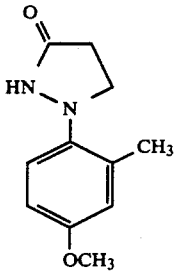
-continued
(X-16)
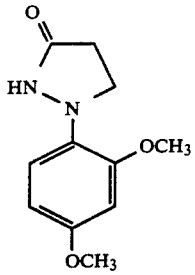
(X-17)
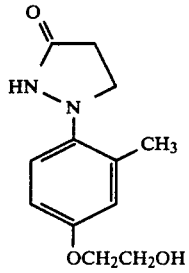
(X-18)
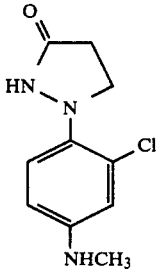
(X-19)
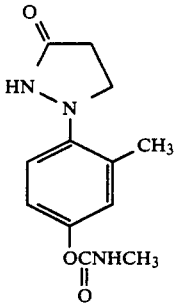
(X-20)
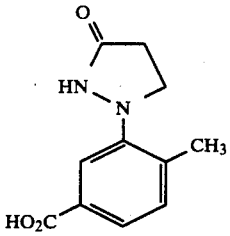
(X-21)
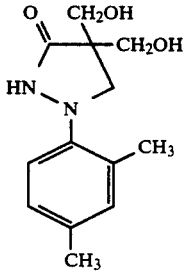

-continued

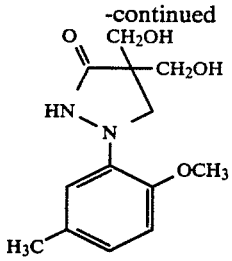

(X-22)

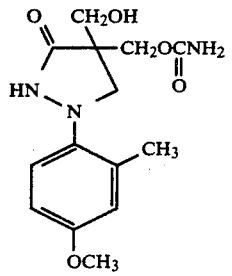

(X-23)

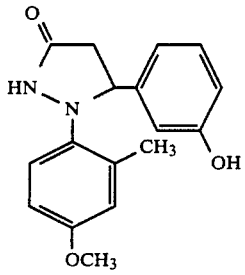

(X-24)

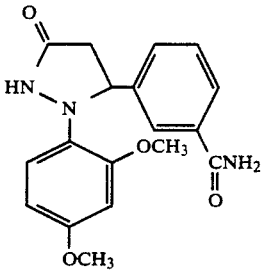

(X-25)

A method for synthesis of the compound represented by formula (I) according to the present invention is illustrated below.

SYNTHESIS EXAMPLE

Synthesis of Compound (X-1)

To a mixture of 12.6 g (92.6 mmol) of 2,5-dimethylphenylhydrazine, 12.4 g (92.6 mmol) of 2,2-bis(hydoxymethyl)propionic acid and 70 ml of acetonitrile, was added dropwise an acetonirile solution containing 19.1 g (92.7 mmol) of dicyclohexylcarbodiimide at room temperature. The mixture was reacted at room temperature for 3 hours, then the dicyclohexylurea subsidiarily produced was removed by filtration. To the filtrate was added 2 ml of sulfuric acid, and the mixture was heated at normal pressure to distill off the solvent. The residue was purified by silica gel column chromatography to obtain 10.0 g (yield: 46%) of Compound (X-1) having a melting point of 106° to 108° C. as colorless crystals.

In accordance with the present invention, the reducible dye providing compound is associated with a binder and a silver halide emulsion together with the electron transfer agent and the electron donor to form a light-sensitive layer unit. The reducible dye providing compound can be added to a layer containing a silver halide emulsion or separately to a layer adjacent thereto. In the latter case, the layer containing the reducible dye providing compound is preferably positioned under the silver halide emulsion layer from the standpoint of sensitivity. In such a case, the electron transfer agent and the electron donor can be added to any of the silver halide emulsion layer and the layer containing the reducible dye providing compound, however, it is preferred that at least the electron transfer agent is added to the silver halide emulsion layer.

According to one embodiment of the present invention, at least two light-sensitive layer units as described above are employed. In order to reproduce full color, three light-sensitive layer units having different spectral sensitivities are ordinarily provided. For example, a combination of a blue-sensitive layer, a green-sensitive layer and a red-sensitive layer, and a combination of a green-sensitive layer, red-sensitive layer and an infrared-sensitive layer are suitable. These light-sensitive layers are positioned according to various orders known in conventional type color light-sensitive materials. Further, each of these light-sensitive layers may be divided into two or more layers, if desired.

The reducible dye providing compound which can be used in the present invention will be described in detail below.

The reducible dye providing compound used in the present invention is preferably a compound represented by formula (C-I):

$$\text{PWR}\text{-}(\text{Time})_t\text{-}\text{Dye} \qquad \text{(C-I)}$$

wherein PWR represents a group capable of releasing $\text{-}(\text{Time})_t\text{-}$Dye upon reduction; Time represents a group capable of releasing Dye by a subsequent reaction after $\text{-}(\text{Time})_t\text{-}$Dye is released from PWR; t is an integer of 0 or 1; and Dye represents a dye or a precursor thereof.

Now, PWR in formula (C-I) is described in greater detail.

In formula (C-I), PWR may be a group containing an electron acceptive center and an intramolecular nucleophilic displacement reaction center in a compound capable of releasing a photographic reagent upon a nucleophilic displacement reaction in the molecule after being reduced as described, for example, in U.S. Pat. Nos. 4,139,389, 4,139,379 and 4,564,577, JP-A-59-185333 and JP-A-57-84453 (the term "JP-A" as used herein means an "unexamined published Japanese patent application"); or may be a group containing an electron acceptive quinoid center in a compound capable of releasing a photographic reagent upon an intramolecular electron transfer reaction after being reduced and a carbon atom bonding the quinoid center and the photographic reagent as described, for example, in U.S. Pat. No. 4,232,107, JP-A-59-101649, *Research Disclosure*, No. 24025 (1984), and JP-A-61-88257. Also, PWR in formula (C-I) may be a group containing an aryl group substituted with an electron attractive group in a compound capable of releasing a photographic reagent by cleaving the single bond after being reduced and an atom (sulfur atom, carbon atom, or nitrogen atom) bonding the aryl group and the photographic reagent as described, for example, in JP-A-56-142530, and U.S. Pat. Nos. 4,343,893 and 4,619,884.

Furthermore, PWR in formula (C-I) may be a group containing a nitro group in a nitro compound capable of releasing a photographic reagent after receiving an electron, and a carbon atom bonding the nitro group and the photographic reagent as described, for example, in U.S. Pat. No. 4,450,223; or may be a group containing a dieminaldinitro moiety in a dinitro compound capable of $\beta$-releasing a photographic reagent after receiving an electron, and a carbon atom bonding the dieminaldinitro moiety and the photographic reagent as described, for example, in U.S. Pat. No. 4,609,610.

Moreover, PWR includes a compound containing an $SO_2$—X bond (wherein X represents oxygen, sulfur or nitrogen) and an electron attractive group in its molecule as described, for example, in U.S. patent application Ser. No. 07/188,779; a compound containing a PO—X bond (wherein X has the same meaning as described above) and an electron attractive group in its molecule as described, for example, in JP-A-63-271344; and a compound containing a C—X' bond (wherein X' represents oxygen, sulfur, nitrogen or —$SO_2$—) and an electron attractive group in its molecule as described, for example, in JP-A-63-271341.

In the present invention, it is preferred to use a compound represented by formula (C-II) described below as the compound represented by formula (C-I).

(C-II)

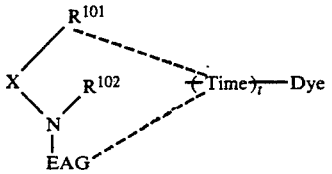

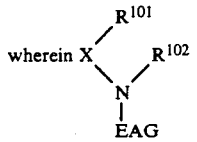

corresponds to PWR in formula (C-I) and X represents oxygen (—O—), sulfur (—S—) or a nitrogen-containing group (—N($R^{103}$)—); EAG represents a group capable of receiving an electron from a reducing substance; $R^{101}$, $R^{102}$ and $R^{103}$, which may be the same or different, each represents a simple bond or a group other than hydrogen, and $R^{101}$, $R^{102}$ and $R^{103}$ may combine with each other to form a 5-membered to 8-membered ring; provided that $\text{-(Time)}_t$Dye is bonded to at least one of $R^{101}$, $R^{102}$ or EAG; and Time, t and Dye each has the same meaning as defined in formula (C-I).

Suitable examples of the group other than hydrogen represented by $R^{101}$, $R^{102}$ or $R^{103}$ include an alkyl group, an aralkyl group, an alkenyl group, an alkynyl group, an aryl group, a heterocyclic group, an acyl group, a sulfonyl group, a carbamoyl group and a sulfamoyl group. These groups may have one or more substituents.

$R^{101}$ and $R^{103}$ each preferably represents a substituted or unsubstituted alkyl group, alkenyl group, alkynyl group, aryl group, heterocyclic group, acyl group or sulfonyl group. The total number of carbon atoms included in each of and $R^{101}$ is preferably from 1 to 40.

$R^{102}$ preferably represents a substituted or unsubstituted acyl group or sulfonyl group. The total number of carbon atoms included in $R^{102}$ is preferably from 1 to 40.

X is particularly preferably oxygen.

EAG is described in more detail below.

Among the compounds represented by formula (C-II), those represented by formula (C-III) described below are preferred.

(C-III)

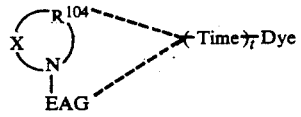

wherein $\text{-(Time)}_t$Dye is bOnded to at least one of $R^{104}$ and EAG; X, EAG, Time, t and Dye each has the same meaning as defined in formula (C-II); and $R_{104}$ represents an atomic group bonded to X and the nitrogen atom necessary to form a 5-membered to 8-membered monocyclic or condensed heterocyclic ring together with X and the nitrogen atom.

As described above, EAG is a group capable of receiving an electron from a reducing substance and is bonded to the nitrogen atom of the compound.

The group represented by EAG is preferably a group represented by formula (A):

(A)

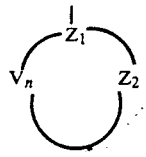

wherein $Z_1$ represents

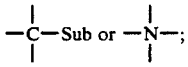

Vn represents an atomic group necessary to form a 3-membered to 8-membered atomatic ring together with $Z_1$ and $Z_2$; n represents an integer from 3 to 8; $V_n$ means the following:

$V_3$: —$Z_3$—, $V_4$: —$Z_3$—$Z_4$—, $V_5$: —$Z_3$—$Z_4$—$Z_5$, $V_6$: —$Z_3$—$Z_4$—$Z_5$—$Z_6$—, $V_7$: —$Z_3$—$Z_4$—$Z_5$—$Z_6$—$Z_7$—, and $V_8$: —$Z_3$—$Z_4$—$Z_5$—$Z_6$—$Z_7$—$Z_8$—; $Z_2$ to $Z_8$ each represents

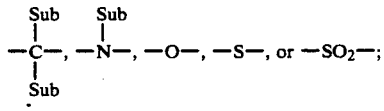

and Sub represents a simple bond ($\pi$ bond), hydrogen or a substituent. Plural Sub groups may be the same or different and may be linked to form a 3-membered to 8-membered saturated or unsaturated carbon ring or heterocyclic ring.

In formula (A), the Sub groups are selected such that the total of the Hammett's substituent constants $\sigma p$ of the Sub groups 1s preferably at least +0.50, more preferably at least +0.70, and most preferably at least +0.85.

EAG is preferably an aryl group or a heterocyclic group, each group being substituted with at least one electron attractive group.

The substituent for the aryl group or heterocyclic group, represented by EAG can be utilized for controlling the properties of the compound of formula (C-II) or (C-III). For example, the substituent for EAG can be utilized for controlling the electro-negativity of the compound as well as controlling other properties for the compound, such as water-solubility, oil-solubility, diffusibility, sublimatibility, melting point, dispersibility in a binder such as gelatin, reactivity for a nucleophilic group, and reactivity for an electrophilic group.

Specific examples of EAG are described, for example, in European Patent 220,746A2, pages 6 to 7.

In the above described formulae, Time represents a group capable of releasing Dye by a subsequent reaction, with the cleavage of a nitrogen-oxygen bond, a nitrogen-nitrogen bond or a nitrogen-sulfur bond as a trigger.

Various groups represented by Time are known and described, for example, in JP-A-61-147244, pages 5 to 6, JP-A-61-236549, pages 8 to 14, and JP-A-62-215270, pages 36 to 44.

In the above described formulae, the dye represented by Dye includes, for example, an azo dye, an azomethine dye, an anthraquinone dye, a naphthoquinone dye, a styryl dye, a nitro dye, a quinoline dye, a carbonyl dye, and a phthalocyanine dye. Further, these dyes may be employed in a form temporarily shifted to a shorter wavelength region which is capable of recoloration during development processing.

Specific examples of Dye which can be used in the present invention are described, for example, in European Patent 76,492A and JP-A-59-165054.

The compound represented by formula (C-II) or (C-III) described above is requested to be immobile itself in the photographic layer. Therefore, it is preferred to contain a ballast group having at least 8 carbon atoms in the group represented by EAG, $R^{101}$, $R^{102}$, $R^{104}$ or X, particularly in the group represented by EAG.

Representative examples of the reducible dye providing compounds which can be used in the present invention are specifically illustrated below, but the present invention is not to be construed as being limited thereto.

In addition, the dye providing compounds as described in European Patent 220,746A2 and *Kokai Giho* 87-6199 can also be employed.

(1)

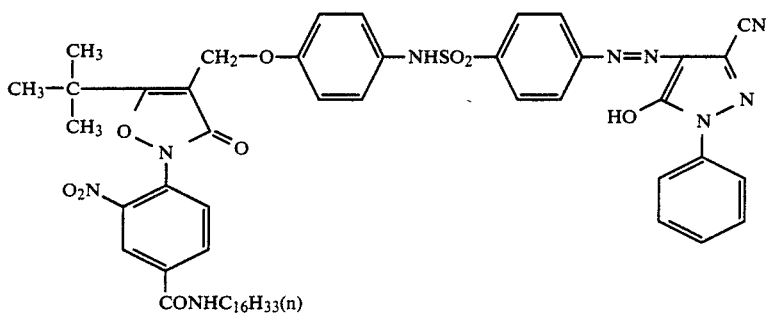

(2)

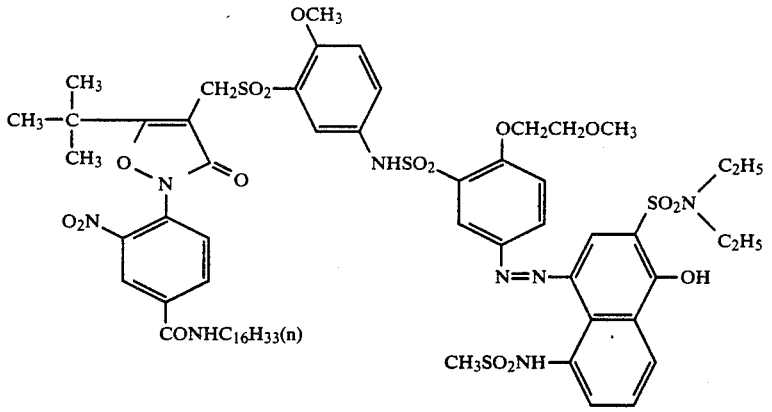

(3)

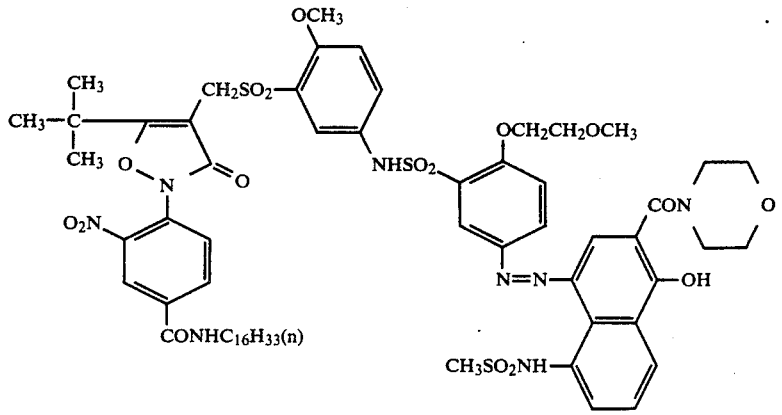

-continued
(4)
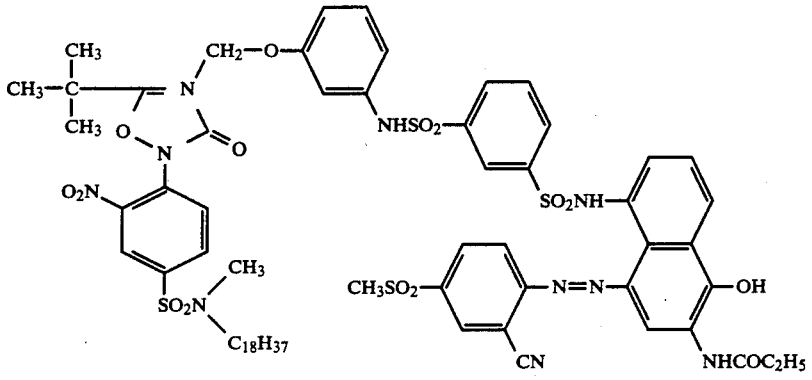
(5)
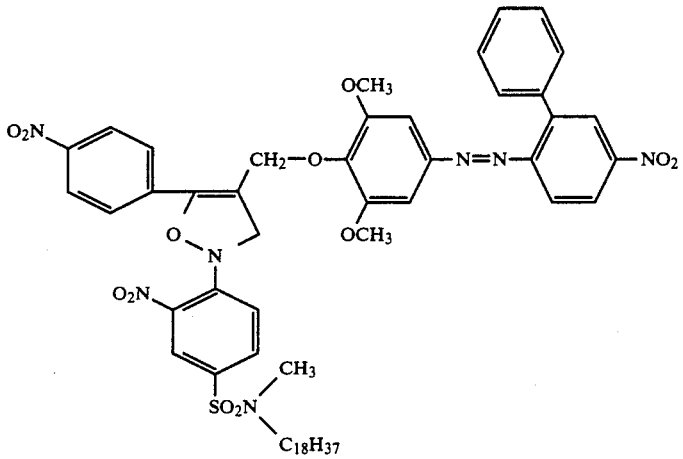
(6)
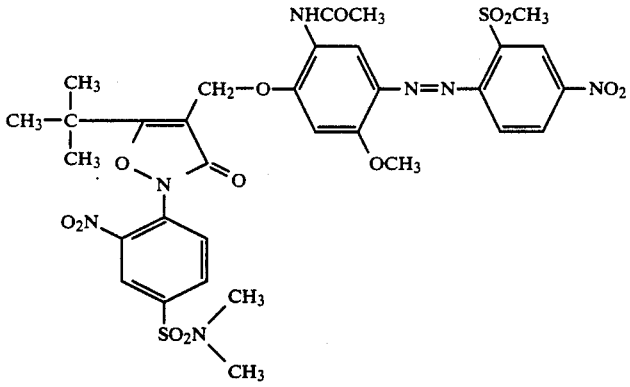
(7)
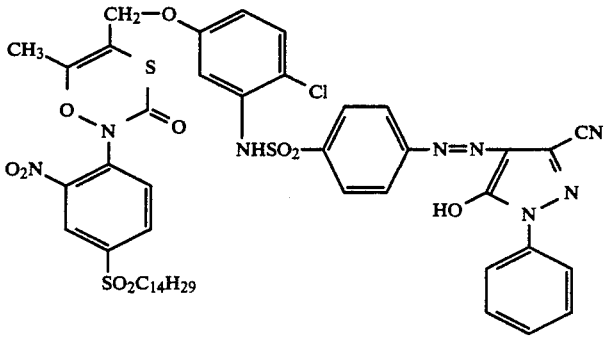

-continued
(8)
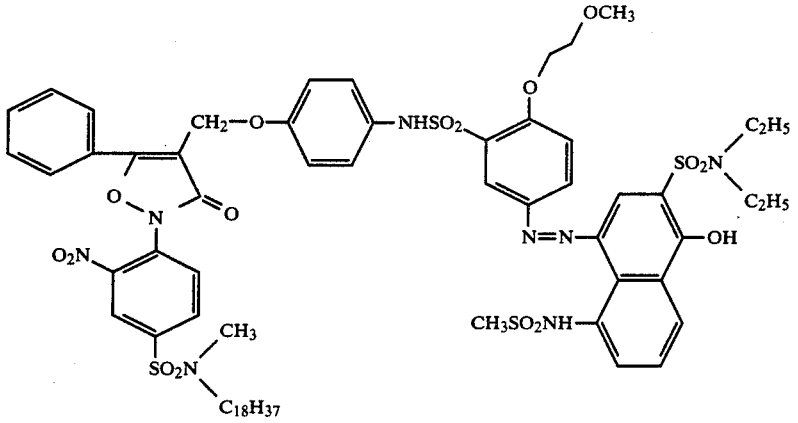
(9)
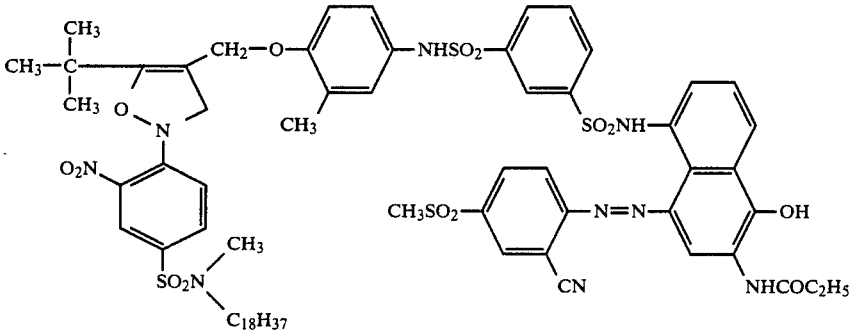
(10)
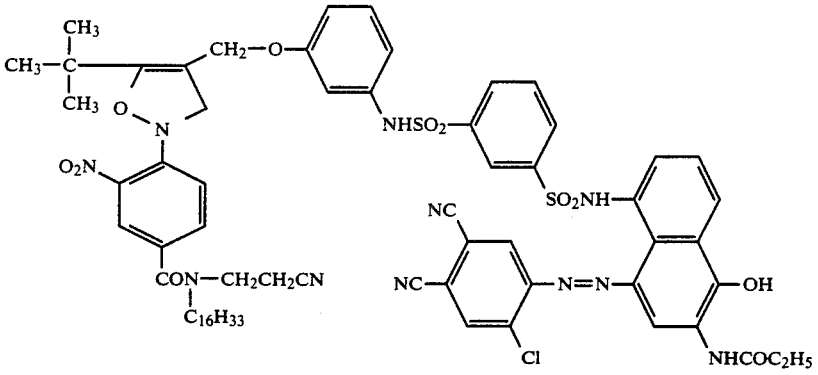
(11)
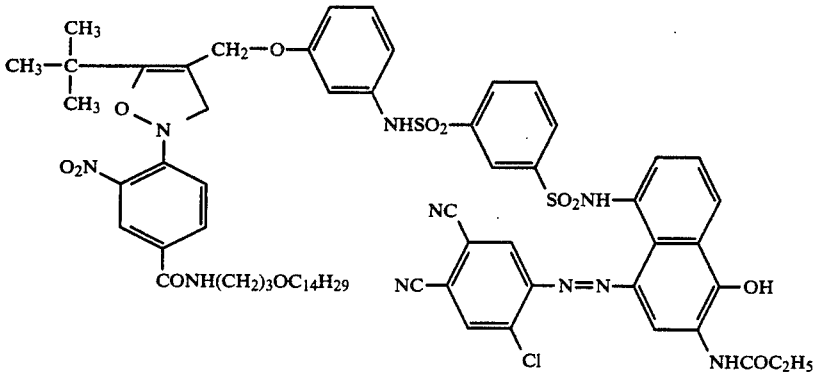

-continued
(12)
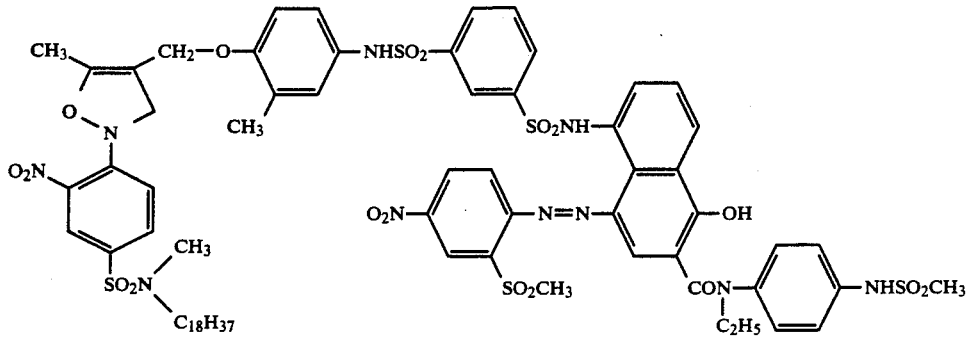
(13)
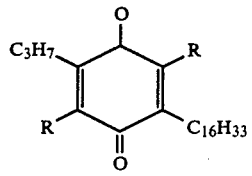
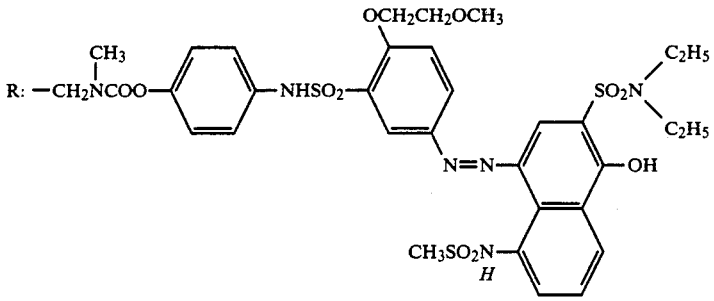
(14)
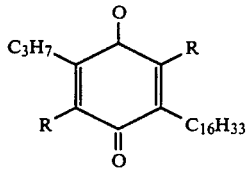
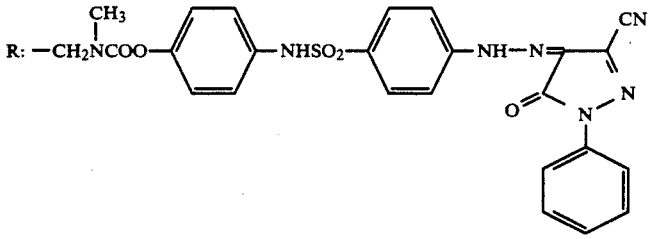
(15)
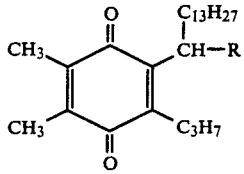

-continued

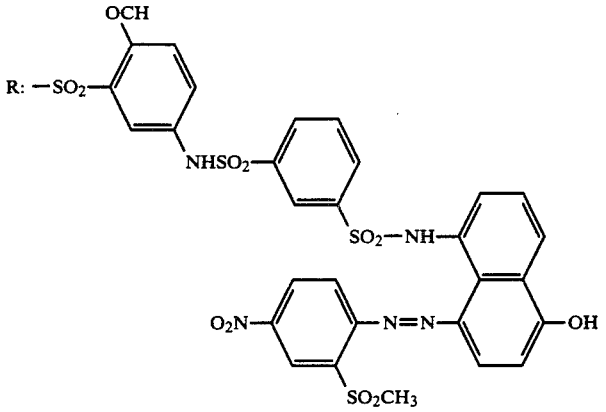

(16)

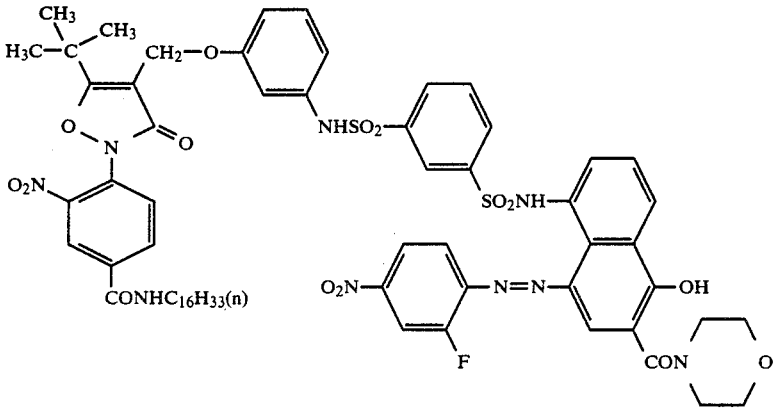

These compounds can be synthesized according to the methods as described in the patent specifications referred to above.

The amount of the dye providing compound used is varied depending on the absorption coefficient thereof, but is generally in a range from 0.05 to 5 mmol/m$^2$, preferably in a range from 0.1 to 3 mmol/m$^2$.

The reducible dye providing compound according to the present invention can be employed individually or in a combination of two or more thereof. Further, in order to obtain a black image or different hue images, two or more kinds of dye providing compounds capable of releasing mobile dyes having different hues may be used together. For example, at least one of each cyan, magenta and yellow dye providing compounds can be incorporated in a mixture into a layer containing silver halide or a layer adjacent thereto as described in JP-A-60-162251.

In the present invention, the electron donor and the electron transfer agent (ETA) are employed as described above. These compounds are known in the art and described in greater detail, for example, in European Patent 220,746A2 and *Kokai Giho* 87-6199.

Particularly preferred electron donors or precursors thereof used include compounds represented by formula (C) or (D):

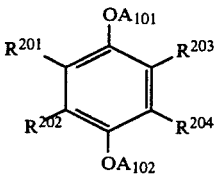

(C)

-continued

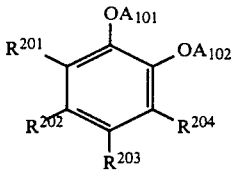

(D)

wherein $A_{101}$ and $A_{102}$, which may be the same or different, each represents hydrogen or a protective group for a phenolic hydroxyl group, which is capable of being removed by a nucleophilic reagent, or $A_{101}$ or $A_{102}$ may combine with $R^{201}$, $R^{202}$, $R^{203}$ or $R^{204}$ to form a ring; and $R^{201}$, $R^{202}$, $R^{203}$ and $R^{204}$, which may be the same or different, each represents hydrogen, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group, provided that the total number of carbon atoms included in $R^{201}$ to $R^{204}$ is at least 8, or $R^{201}$ and $R^{202}$ and/or $R^{203}$ and $R^{204}$ in formula (C), or $R^{201}$ and $R^{202}$, $R^{202}$ and $R^{203}$ and/or $R^{203}$ and $R^{204}$ in formula (D) may be linked to form a saturated or unsaturated ring.

The nucleophilic reagent described above includes an anionic reagent, for example, $OH^{\ominus}$, $RO^{\ominus}$ (wherein R represents an alkyl group or an aryl group), a hydroxamic acid anion and $SO_3^{2\ominus}$ and a compound having a non-covalent electron pair, for example, a primary or secondary amine, a hydrazine, a hydroxylamine, an alcohol, and a thiol.

Preferred examples of $A_{101}$ and $A_{102}$ include hydrogen, an acyl group, an alkylsulfonyl group, an arylsulfonyl group, an alkoxycarbonyl group, an aryloxycarbonyl group, a dialkylphosphoryl group or a diarylphosphoryl group. Further, the protective groups described in JP-A-59-197037 and JP-A-59-20105 are also preferably used.

The group represented by $R^{201}$, $R^{202}$, $R^{203}$ or $R^{204}$ may have one or more substituents.

Of the electron donors represented by formula (C) or (D) described above, those wherein at least two of $R^{201}$ to $R^{204}$ are substituents other than hydrogen are preferred. Further, compounds wherein at least one of $R^{201}$ and $R^{202}$, and at least one of $R^{203}$ and $R^{204}$ are substituents other than hydrogen are particularly preferred.

Two or more of electron donors may be used in combination and an electron donor and a precursor of an electron donor may be used in combination. Further, the electron donor used may be the same compound as the reducing substance used in the present invention.

Specific examples of the electron donors used in the present invention are set forth below, but the present invention is not to be construed as being limited thereto.

(ED-1)

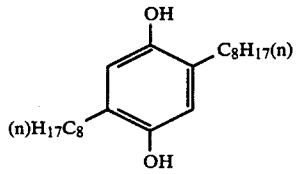

(ED-2)

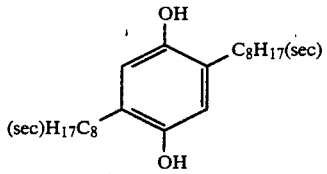

(ED-3)

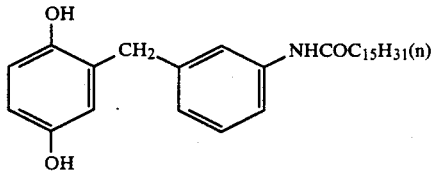

(ED-4)

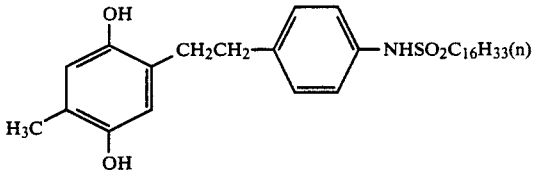

(ED-5)

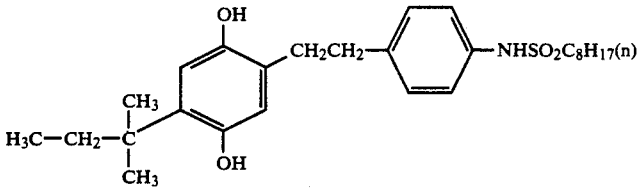

(ED-6)

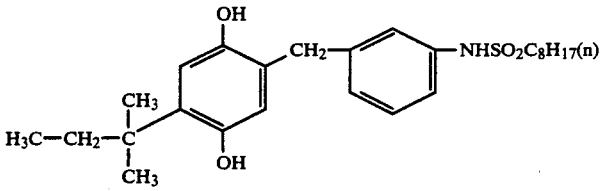

(ED-7)

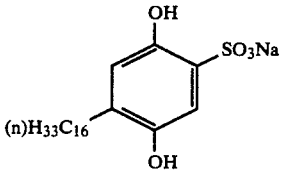

-continued (ED-8)

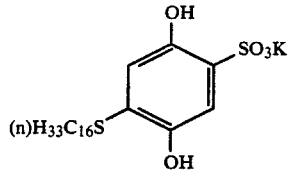

(ED-9)

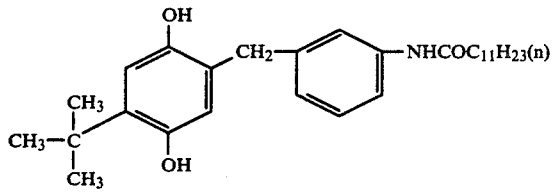

(ED-10)

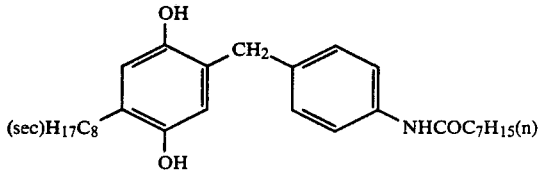

(ED-11)

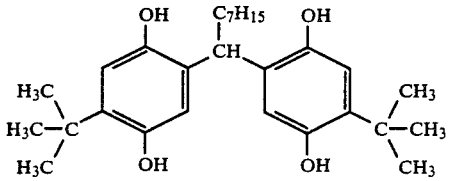

(ED-12)

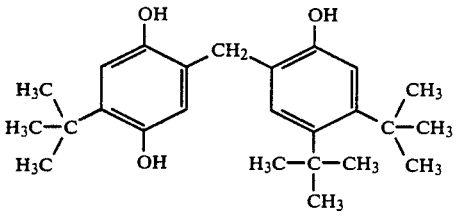

(ED-13)

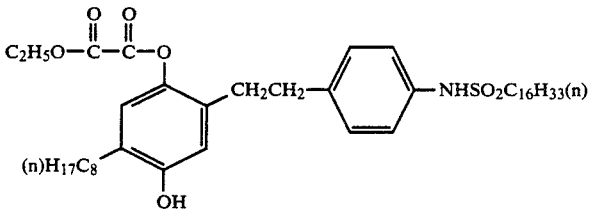

(ED-14)

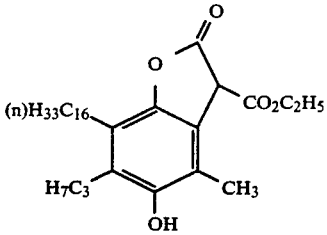

While the electron donor (or precursor thereof) can be employed in a wide range, it is preferably used in a range from 0.01 to 50 mol, particularly from 0.1 to 5 mol, per mol of the dye providing compound Further, it is used in a range from 0.001 to 5 mol, preferably from 0.01 to 1.5 mol, per mol of silver halide.

In order to incorporate the reducing substance, the dye providing compound, the electron donor, the electron transfer agent or precursor thereof and other hydrophobic additives into a hydrophilic colloid layer, methods described in U.S. Pat. No. 2,322,027, in which these compounds are dissolved in an organic solvent having a high boiling point can be employed. Examples of the organic solvent having a high boiling point include alkyl esters of phthalic acid (e.g., dibutyl phthalate or dioctyl phthalate), phosphoric acid esters (e.g., diphenyl phosphate, triphenyl phosphate, tricyclohexyl phosphate, tricresyl phosphate, or dioctylbutyl phosphate), citric acid esters (e.g., acetyl tributyl citrate), benzoic acid esters (e.g., octyl benzoate), alkylamides (e.g., diethyllaurylamide), fatty acid esters (e.g., dibutoxyethyl succinate or dioctyl azelate), trimesic acid esters (e.g., tributyl trimesate), carboxylic acids as described in JP-A-63-85633, and compounds as described in JP-A-59-83154, JP-A-59-178451, JP-A-59-178452, JP-A-59-178453, JP-A-59-178454, JP-A-59-178455 and JP-A-59-178457.

Alternatively, they are dissolved in an organic solvent having a boiling point of from about 30° C. to 160° C., such as lower alkyl acetates (e.g., ethyl acetate or butyl acetate), ethyl propionate, sec-butyl alcohol, methyl isobutyl ketone, 8-ethoxyethyl acetate, methyl cellosolve acetate, or cyclohexanone, and then dispersed in a hydrophilic colloid. The above described organic solvents having a high boiling point and organic solvents having a low boiling point may be used as a mixture thereof. The organic solvent having a low boiling point may be removed by ultrafiltration or other methods from the dispersion, if desired.

The amount of the organic solvent having a high boiling point used in the present invention is at most 10 g, preferably at most 5 g, per g of the dye providing compound used. It is at most 5 g, preferably at most 2 g, per g of the diffusion resistant reducing agent Also, it is at most 1 g, preferably at most 0.5 g, and more preferably 0.3 g, per g of the binder.

Further, it is possible to use a dispersion method using a polymer as described in JP-B-51-39853 (the term "JP-B" as used herein means an "examined Japanese patent publication") and JP-A-51-59943. In addition, the compound may be dispersed directly in an emulsion, or first dissolved in water or an alcohol and then dispersed in gelatin or an emulsion In case of using substantially water-insoluble compounds, they can be dispersed as fine particles in a binder, in addition to the above described methods, as described, for example, in JP-A-59-174830, JP-A-53-102733 and JP-A-63-271339.

In order to disperse the hydrophobic substances a hydrophilic colloid, various surface active agents can be employed For this purpose, surface active agents as described in JP-A-59-157636, pages 37 to 38 are suitably employed.

The heat-developable light-sensitive material according to the present invention comprises, in substance, a support having thereon light-sensitive silver halide, a binder, an electron donor, an electron transfer agent and a reducible dye providing compound. Further, it may contain an organic metal salt oxidizing agent, if desired These compounds are ordinarily added to the same layer in many cases, but may be separately added to different layers as far as they are capable of reacting with each other. For example, a decrease in sensitivity can be prevented by incorporating the dye providing compound which is colored into a layer under the silver halide emulsion layer.

The reducing agent is preferably incorporated into the heat-developable light-sensitive material, but may be supplied from outside, by an appropriate method for example, by diffusion from a dye fixing material as described hereinafter.

In order to obtain a wide range of color in a chromaticity diagram using the three primary colors of yellow, magenta and cyan, at least three silver halide emulsion layers each having sensitivity in a different spectral range are employed in combination. For example, a combination of a blue-sensitive layer, a green-sensitive layer and a red-sensitive layer and a combination of a green-sensitive layer, a red-sensitive layer and an infrared-sensitive layer can be used. These light-sensitive layers can be positioned in various orders known for conventional color light-sensitive materials. Further, each of these light-sensitive layers may be divided into two or more layers, if desired.

The heat-developable light-sensitive material may have various subsidiary layers, for example, a protective layer, a subbing layer, an interlayer, a yellow filter layer, an antihalation layer, or a back layer.

The silver halide which can be used in the present invention may be any one of silver chloride, silver bromide, silver iodobromide, silver chlorobromide, silver chloroiodide, and silver chloroiodobromide.

The silver halide emulsion used in the present invention is a surface latent image type silver halide emulsion. The surface latent image type emulsion is an emulsion in which latent images are formed mainly in the surface portion of grains, and is also called a negative type emulsion. The definition of the surface latent image type emulsion is described in JP-B-58-9410. The silver halide emulsion to be used in the present invention may be a core/shell emulsion in which the surface thereof differs from the interior thereof in phase.

The silver halide emulsion can be a monodispersed emulsion or a polydispersed emulsion. Also, a mixture of two or more monodispersed emulsions can be employed. The particle size of silver halide grains is preferably from 0.1 to 2 $\mu$m, particularly from 0.2 to 1.5 $\mu$m. The crystal habit of the silver halide grains may be any of cubic, octahedral, tetradecahedral or high aspect ratio tabular grains.

Suitable examples of silver halide emulsion which can be used are described, for example, in U.S. Pat. Nos. 4,500,626 (50th column) and 4,628,021, *Research Disclosure*, No. 17029 (1978), and JP-A-62-253159.

The silver halide emulsion may be used unripened. However, it is normally chemically sensitized before use. The silver halide emulsion may be subjected to a sulfur sensitization process, a reduction sensitization process, and a noble metal sensitization process, alone or in combination as is known for conventional type light-sensitive materials. These chemical sensitization processes may be effected in the presence of a nitrogen-containing heterocyclic compound as described in JP-A-62-253159.

In the present invention, the amount of light-sensitive silver halide to be coated is in the range from 1 mg/m$^2$ to 10 g/m$^2$ in terms of silver.

In the heat-developable light-sensitive material according to the present invention, an organic metal salt may be employed as an oxidizing agent together with light-sensitive silver halide. Among the organic metal salts, organic silver salts are particularly preferred.

Examples of organic compounds which can be used to form the above-described organic silver salt oxidizing agent include benzotriazoles, fatty acids and other compounds as described, for example, in U.S. Pat. No. 4,500,626 (52nd column to 53rd column). Other useful examples of such organic compounds include silver salts of carboxylic acids containing an alkynyl group such as silver phenylpropiolate as described in JP-A-60-113235 and acetylene silver as described in JP-A-61-249044. Two or more organic silver salts may be used in combination.

These organic silver salts may be used in an amount of from 0.01 to 10 mol, preferably from 0.01 to 1 mol, per mol of light-sensitive silver halide. The total amount of light-sensitive silver halide and organic silver salt to be coated is preferably in the range of 50 mg to 10 g/m$^2$ in terms of silver.

In the present invention, various antifogging agents or photographic stabilizers may be used. Examples of such antifogging agents or photographic stabilizers used include azoles and azaindenes as described in *Research Disclosure,* No. 17643, pages 24 and 25 (1978), carboxylic acids or phosphoric acids containing nitrogen as described in JP-A-59-168442, mercapto compounds and salts thereof as described in JP-A-59-111636, and acetylene compounds as described in JP-A-62-87957.

The silver halide to be used in the present invention may be spectrally sensitized with a methine dye or the like. Examples of such dyes used include cyanine dyes, merocyanine dyes, complex cyanine dyes, complex merocyanine dyes, halopolar cyanine dyes, hemicyanine dyes, styryl dyes and hemioxonol dyes.

Specific examples of such dyes include sensitizing dyes as described in U.S. Pat. No. 4,617,257, JP-A-59-180550, JP-A-60-140335, and *Research Disclosure,* No. 17029, pages 12 and 13 (1978).

These sensitizing dyes may be used alone or in combination. Such a combination of sensitizing dyes is often used particularly for the purpose of supersensitization.

Besides such a sensitizing dye, the present emulsion may contain a dye which has no spectral sensitizing effect itself but exhibits a supersensitizing effect or a substance which does not substantially absorb visible light but exhibits a supersensitizing effect as described in U.S. Pat. No. 3,615,641, and JP-A-63-23145.

The sensitizing dye may be added to the emulsion during, before or after chemical ripening. Alternatively, it may be added before or after the formation of the nucleus of the silver halide grains in accordance with U.S. Pat. Nos. 4,183,756 and 4,225,666.

The amount of the sensitizing dye added is normally in the range from about $10^{-8}$ to $10^{-2}$ mol per mol of silver halide.

As binders of layers constituting the light-sensitive material or dye fixing material, hydrophilic binders are preferably employed. Examples of such binders are described in JP-A-62-253159, pages 26 to 28. More specifically, transparent or translucent hydrophilic binders are preferred. Suitable examples of such binders include natural substances such as proteins (for example, gelatin and gelatin derivatives), polysaccharides (for example, cellulose derivatives, starch, gum arabic, dextrin and pullulan), and synthetic polymer compounds (for example, polyvinyl alcohol, polyvinyl pyrrolidone and acrylamide polymers).

Further examples of binders include highly water absorptive polymers, that is, homopolymers of vinyl monomer containing —COOM or —$SO_3M$ (M represents hydrogen or an alkali metal) or copolymers composed of two or more of such vinyl monomers or composed of such a vinyl monomer and another vinyl monomer (for example, sodium methacrylate, ammonium methacrylate and Sumikagel ® L-5H manufactured by Sumitomo Chemical Co., Ltd.) as described, for example, in JP-A-62-245260.

Two or more of these binders may be employed in combination.

When heat development is conducted together with supplying a slight amount of water, it becomes possible to absorb water rapidly using the above-described highly water absorptive polymer. Further, re-transfer of dyes from a dye fixing material to other materials after dye transfer is prevented by incorporating the highly water absorptive polymer into a dye fixing layer or a protective layer thereof.

In the present invention, the amount of the binder to be coated is preferably 20 g or less, more preferably 10 g or less, particularly preferably 7 g or less, per square meter.

Into layers constituting the light-sensitive material or dye fixing material (including a backing layer), various polymer latexes can be incorporated for the purpose of improving physical properties of layers, such as increasing dimensional stability and preventing curling, blocking, cracking and pressure sensitization or desensitization. Specifically, any of the polymer latexes described, for example, in JP-A-62-245258, JP-A-62-136648 and JP-A-62-110066 may be employed. In particular, the cracking of a mordanting layer can be prevented using a polymer latex having a low glass transition point (40° C. or less) in the mordanting layer, and curling is effectively prevented by adding a polymer latex having a high glass transition point to the backing layer.

In the present invention, the light-sensitive material may contain a compound which serves to activate development as well as to stabilize images. Specific examples of such compounds which can be preferably used in the present invention are described in U.S. Pat. No. 4,500,626 (51st column to 52nd column).

In a system which employs diffusion transfer of dyes to form images, a dye fixing material is used together with a light-sensitive material. An embodiment in which a light-sensitive material and a dye fixing material are separately coated on two supports and an embodiment in which a light-sensitive material and a dye fixing material are coated on the same support can be employed.

For the relationship between the light-sensitive material and the dye fixing material, between the light-sensitive material and the support, and between the light-sensitive material and a white reflecting layer, those described in U.S. Pat. No. 4,500,626 (57th column) can be used in the present invention.

The dye fixing material which is preferably used in the present invention has at least one layer containing a mordant and a binder. Mordants which can be used in the present invention include those known in the field of photography, and specific examples include those described, for example, in U.S. Pat. No. 4,500,626 (58th column to 59th column), JP-A-61-88256 (pages 32 to 41), JP-A-62-244043 and JP-A-62-244036. Further, dye receptive polymer compounds as described in U.S. Pat. No. 4,463,079 may be employed.

The dye fixing material may have a subsidiary layer, for example, a protective layer, a stripping layer and an anti-curling layer, if desired. Particularly, it is effective to provide a protective layer.

To the layers of the light-sensitive material and dye fixing material, plasticizers, slipping agents, and organic solvents having a high boiling point as agents for improving the stripping properties of the light-sensitive material and dye fixing material may be added. Specific examples thereof are those described, for example, in JP-A-62-253159 (page 25) and JP-A-62-245253.

Moreover, for the purpose described above, various silicone oils (any silicone oils from dimethyl silicone oil to modified silicone oils obtained by introducing various organic groups to dimethylsiloxane) can be employed. Useful examples of the silicone oils are various modified silicone oils, particularly carboxy-modified silicone (trade name: X-22-3710) as described in *Modified Silicone Oil,* technical data, pages 6 to 18B published by Shin-Etsu Silicone Co. Further, silicone oils as described in JP-A-62-215953 and JP-A-63-46449 are also effective.

In the light-sensitive material and dye fixing material, color fading preventing agents may be employed. Color fading preventing agents which can be used include antioxidants, ultraviolet light absorbing agents and certain kinds of metal complexes.

Suitable examples of antioxidants include chroman series compounds, coumaran series compounds, phenol series compounds (for example, hindered phenols), hydroquinone derivatives, hindered amine derivatives and spiroindane series compounds. Further, the compounds described in JP-A-61-159644 are also effective.

Suitable examples of ultraviolet light absorbing agents include benzotriazole series compounds (described in U.S. Pat. No. 3,533,794), 4-thiazolidone series compounds (described in U.S. Pat. No. 3,352,681), benzophenone series compounds (described in JP-A-46-2784), and compounds described in JP-A-54-48535, JP-A-62-136641 and JP-A-61-88256. Further, the ultraviolet light-absorptive polymers described in JP-A-62-260152 are effective.

Suitable examples of metal complexes include the compounds described in, for example, U.S. Pat. Nos. 4,241,155, 4,245,018 (3rd column to 36th column), and 4,254,195 (3rd column to 8th column), JP-A-62-174741, JP-A-61-88256 (pages 27 to 29), JP-A-1-75568 and JP-A-63-199248.

Suitable examples of color fading preventing agents are described in JP-A-62-215272 (pages 125 to 137).

Color fading preventing agents for the purpose of preventing fading of transferred dyes in the dye fixing material can be previously incorporated into the dye fixing material or may be supplied to the dye fixing material from the outside, for example, from the light-sensitive material.

The above-described antioxidants, ultraviolet light absorbing agents and metal complexes may be used in combination.

In the light-sensitive material and dye fixing material, there may be used fluorescent whitening agents. It is particularly preferred to incorporate fluorescent whitening agents into the dye fixing material or to supply them from the outside of the dye fixing material, for example, from the light-sensitive material. Suitable examples of fluorescent whitening agents are described, for example, in K. Veenkataraman, *The Chemistry of Synthetic Dyes,* Vol. V, Chapter 8 and JP-A-61-143752. More specifically, preferred fluorescent whitening agents include stilbene series compounds, coumarin series compounds, biphenyl series compounds, benzoxazole series compounds, phthalimide series compounds, pyrazoline series compounds and carbostyryl series compounds.

The fluorescent whitening agents may be employed in combination with the color fading preventing agents.

Suitable examples of hardening agents which can be used in the layers constituting the light-sensitive material or dye fixing material include those described, for example, in U.S. Pat. No. 4,678,739 (41st column), JP-A-59-116655, JP-A-62-245261 and JP-A-61-18942. More specifically, aldehyde series hardeners (for example, formaldehyde), aziridine series hardeners, epoxy series hardeners (for example,

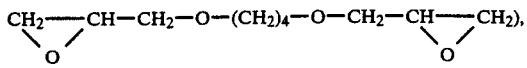

vinylsulfone series hardeners (for example, N,N'-ethylenebis(vinylsulfonylacetamido)ethane), N-methylol series hardeners (for example, dimethylolurea), and polymer hardeners (for example, the compounds described in JP-A-62-234157).

In the layers constituting the light-sensitive material and dye fixing material, various surface active agents are employed as coating aids or for other purposes, for example, improvement in stripping properties, improvement in sliding properties, antistatic properties, and development acceleration. Specific examples of useful surface active agents are described, for example, in JP-A-62-173463 and JP-A-62-183457.

Into the layers constituting the light-sensitive material or dye fixing material, organic fluoro compounds may be incorporated for the purpose of improvement in sliding properties, antistatic properties, and improvement in stripping properties. Typical examples of the organic fluoro compounds include fluorine series surface active agents as described, for example, in JP-B-57-9053 (8th column to 17th column), JP-A-61-20944 and JP-A-62-135826, oily fluorine series compounds such as fluoro oil, and hydrophobic fluorine compounds such as solid fluoro resin compounds, for example, tetrafluoroethylene resins.

In the light-sensitive material and dye fixing material, matting agents can be used. Suitable examples of matting agents include silicon dioxide, compounds such as polyolefins and polymethacrylates as described in JP-A-61-88256 (page 29), as well as compounds such as benzoguanamine resin beads, polycarbonate resin beads and AS resin beads described in JP-A-63-279944 and JP-A-63-274952.

Furthermore, into the layers constituting the light-sensitive material and dye fixing material, other additives, for example, heat solvents, defoaming agents, sterilizers, antimolds, and colloidal silica may be incorporated. Specific examples of these additives used are described in JP-A-61-88256 (pages 26 to 32).

In the light-sensitive material and/or dye fixing material according to the present invention, image formation accelerating agents can be employed. Such image formation accelerating agents serve to accelerate, for example, an oxidation reduction reaction of a silver salt oxidizing agent with a reducing agent, a reaction such as formation or decomposition of a dye or release of a diffusible dye from a dye providing compound, and migration of a dye from a light-sensitive material layer to a dye fixing layer. In the light of physicochemical function, image formation accelerating agents can be classified into bases or base precursors, nucleophilic compounds, organic solvents having a high boiling point (oils), heat solvents, surface active agents, and compounds capable of interacting with silver or silver ion. However, these substances generally have a composite function and thus a combination of the above-described accelerating effects. The details thereof are described in U.S. Pat. No. 4,678,739 (38th column to 40th column).

Examples of useful base precursors include salts of organic acids and bases which decompose by heating with decarboxylation, and compounds which release an amine upon decomposition with an intramolecular nucleophilic displacement reaction, a Lossen rearrangement reaction or a Beckmann rearrangement reaction. Specific examples thereof are described, for example, in U.S. Pat. No. 4,511,493 and JP-A-62-65038.

In a system wherein heat development and transfer of dye are simultaneously conducted in the presence of a small amount of water, it is preferred to incorporate a base and/or a base precursor into the dye fixing material from the standpoint of increasing preservability of the light-sensitive material.

In addition, combinations of sparingly soluble metal compounds and compounds (referred to as complex forming compounds) capable of forming a complex with a metal ion constituting the sparingly soluble metal compound as described in European Patent Application (OPI) No. 210,660, and compounds which generate a base upon electrolysis as described in JP-A-61-232451 can be employed as base precursors. Particularly, the former method is effective. It is advantageous that the sparingly soluble metal compound and the complex forming compound are added separately to the light-sensitive material and the dye fixing material.

In the light-sensitive material and/or dye fixing material, various development stopping agents can be used for the purpose of ensuring constant image quality regardless of any fluctuation in processing temperature and time during development.

The term "development stopping agent" as used herein means a compound which rapidly neutralizes or reacts with a base to decrease the base concentration in the layer so that development is stopped after proper development, or a compound which interacts with silver or silver salt to inhibit development after proper development. Specific examples of such development stopping agents include acid precursors which release an acid upon heating, electrophilic compounds which undergo a displacement reaction with a base present therewith upon heating, and nitrogen-containing heterocyclic compounds, mercapto compounds and precursors thereof. More specifically, those described in JP-A-62-253159 (pages 31 and 32) are employed.

Supports used in the light-sensitive material and dye fixing material according to the present invention are those which can endure the processing temperature. In general, paper and synthetic polymer films are employed. More specifically, films of polyethylene terephthalate, polycarbonates, polyvinyl chloride, polystyrene, polypropylene, polyimides and celluloses (for example, triacetyl cellulose) or these films containing pigments such as titanium oxide, synthetic paper produced from polypropylene, paper manufactured from a mixture of synthetic pulp such as polyethylene and natural pulp, Yankee paper, baryta paper, coated paper (particularly cast coated paper), metals, cloths, and glass are employed. These may be employed individually or as supports one or both surfaces of which are laminated with synthetic polymers such as polyethylene. Further, the supports as described in JP-A-62-253159 (pages 29 to 31) are useful.

On the surface of the support, a mixture of a hydrophilic binder and a semiconductive metal oxide such as alumina sol and tin oxide, an antistatic agent such as carbon black may be coated.

In order to imagewise expose the light-sensitive material for recording, various methods can be utilized, for example, directly photographing a landscape or portrait using a camera, a method of exposure through a reversal film or a negative film by means of a printer or an enlarger, a method of scanning exposure of an original through a slit using an exposure device of a copying machine, a method wherein image information is exposed by light emission from a light emitting diode, or various lasers via electric signals, and a method wherein image information on an image display device, for example, a CRT, liquid crystal display, electroluminescence display, or plasma display is exposed directly or through an optical system.

Light sources for recording images on the light-sensitive material which can be used include those as described in U.S. Pat. No. 4,500,626 (56th column) such as natural light, tungsten lamps, light emitting diodes, laser light sources, and CRT light sources, as described above.

Furthermore, image exposure may be conducted using a wavelength conversion element composed of a combination of a nonlinear optical material and a coherent light source such as laser light. The nonlinear optical material is a material capable of generating nonlinearity between polarization and an electric field which occurs when a strong photoelectric field such as laser light is provided. Specific examples of the nonlinear optical materials which can be preferably used include inorganic compounds represented by, for example, lithium niobate, potassium dihydrogenphosphate (KDP), lithium iodate, or $BaB_2O_4$, urea derivatives, nitroaniline derivatives, nitropyridine-N-oxide derivatives such as 3-methyl-4-nitropyridine-N-oxide (POM), or the compounds described in JP-A-61-53462 and JP-A-62-210432. As the form of the wavelength conversion element, a single crystal light conducting wave guide type and a fiber type are known, and they may be effectively employed.

Moreover, the above-described image information sources which may be used include image signals obtained by a video camera or an electro still camera, television signals represented by Japan Television Signal Standard (NTSC), image signals obtained by dividing an original into many dots by means of a scanner, and image signals prepared by means of a computer represented by CG and CAD.

The light-sensitive material and/or dye fixing material may have an electroconductive heat-generating layer (heating element) as a heating means for heat development or diffusion transfer of dyes as the heating element, transparent or opaque in this case, including those described in JP-A-61-145544. The electro-conductive layer acts also as an antistatic layer.

The heating temperature required for the heat development step is ordinarily in the range from about 50° C. to about 250° C., preferably from about 80° C. to about 180° C. The diffusion transfer step of dyes can be performed simultaneously with or after the heat development step. In the latter case, the transfer can be conducted at a temperature ranging from the temperature for the heat development to room temperature, particularly preferably at a temperature ranging from 50° C. to about 10° C. lower than the temperature at the heat development step.

The migration of dyes may occur only by heating, but an appropriate solvent may be employed in order to accelerate the transfer of dyes. Further, as described in detail in JP-A-59-218443 and JP-A-61-238056, a process in which a light-sensitive material is heated in the presence of a small amount of a solvent, particularly water so that development and transfer are simultaneously or sequentially effected is useful. In such a process, the heating temperature is preferably in the range from 50° C. to not higher than the boiling point of the solvent used. For example, if the solvent is water, a suitable heating temperature is in the range from 50° C. to 100° C.

Examples of such a solvent which can be used to accelerate development and/or migration of diffusible dyes to the dye fixing layer include water, and a basic aqueous solution containing an inorganic alkali metal salt or an organic base as described with reference to the image formation accelerator. There can also be used a solvent having a low boiling point, or a mixture of a solvent having a low boiling point and water or a basic aqueous solution. Alternatively, a surface active agent, an antifogging agent, a sparingly soluble metalic salt, or a complex forming compound may be contained in the solvent. Particularly preferred among these solvents is water.

These solvents may be applied to either or both of the dye fixing material and the light-sensitive material. The amount of the solvent to be used may be less than the weight of the solvent of a volume equivalent to the maximum wet volume of the entire coated film (particularly, not more than the value obtained by subtracting the weight of the entire coated film from the weight of the solvent of a volume equivalent to the maximum wet volume of the entire coated film).

Methods for providing such a solvent to the light-sensitive layer or the dye fixing layer which can be used include those described in JP-A-61-147244 (page 26). Alternatively, the solvent may be previously incorporated into either the light-sensitive material or the dye fixing material or both of them in the form of microcapsule.

Furthermore, a system may be used in which a hydrophilic heat solvent which stays solid at normal temperature but melts at an elevated temperature is incorporated in the light-sensitive material or the dye fixing material in order to accelerate the migration of dyes. Such a hydrophilic thermal solvent may be incorporated in either or both of the light-sensitive material and the dye fixing material. The layer in which the hydrophilic thermal solvent incorporated is any of the emulsion layer, interlayer, protective layer, and dye fixing layer, particularly the dye fixing layer and/or an adjacent layer thereto.

Examples of the hydrophilic heat solvent include ureas, pyridines, amides, sulfonamides, imides, alcohols, oximes, and other heterocyclic compounds.

Moreover, in order to accelerate the migration of dyes, an organic solvent having a high boiling point may be incorporated into the light-sensitive material and/or the dye fixing material.

Suitable heating methods for the development step and/or transfer step include contact with a heated block or plate, a hot plate, a hot presser, a hot roller, a halogen lamp heater, or an infrared or far infrared lamp heater, or passing through a high temperature atmosphere.

The pressure condition and pressure application process to be used when the light-sensitive material and the dye fixing material are brought into close contact with each other are described in JP-A-61-147244 (page 27).

Processing of the heat-developable light-sensitive materials according to the present invention can be carried out by means of any of various heat development machines. Preferably used heat development machines include those described, for example, in JP-A-59-75247, JP-A-59-177547, JP-A-59-181353, JP-A-60-18951 and JP-A-U-62-25944 (the term "JP-A-U" as used herein means an "unexamined published Japanese utility model application").

The present invention is now explained in greater detail with reference to the following specific examples, but the present invention is not to be construed as being limited thereto.

EXAMPLE 1

The preparation of Emulsion (I) for the first layer is described below.

To an aqueous gelatin solution (prepared by adding 20 g of gelatin, 1 g of potassium bromide and 0.5 g of $OH(CH_2)_2S(CH_2)_2OH$ to 800 ml of water and maintained at 50° C.) which was thoroughly stirred, were simultaneously added Solution (I), Solution (II) and Solution (III) each described below at the same flow rate over a period of 30 minutes. Thus, a dye adsorbed monodisperse silver bromide emulsion having an average grain size of 0.42 μm was prepared.

After being washed with water and desalted, 20 g of lime-processed ossein gelatin was added thereto and the pH and pAg were adjusted to 6.4 and 8.2, respectively. Then, while maintaining the solution at 60° C., 9 ml of sodium thiosulfate, 6 ml of a 0.01% aqueous solution of chloroauric acid and 190 mg of 4-hydroxy-6-methyl-1,3,3a,7-tetraazaindene were added and chemical sensitization was conducted for 45 minutes. The yield of the emulsion was 635 g.

| | Solution (I) | Solution (II) | Solution (III) |
|---|---|---|---|
| $AgNO_3$ | 100 g | — | — |
| KBr | — | 70 g | — |
| Dye (a) | — | — | 40 mg |
| Dye (b) | — | — | 80 mg |
| | Water to make 450 ml | Water to make 400 ml | Methanol to make 60 ml |

Dye (a)

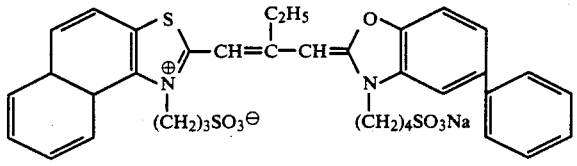

Dye (b)

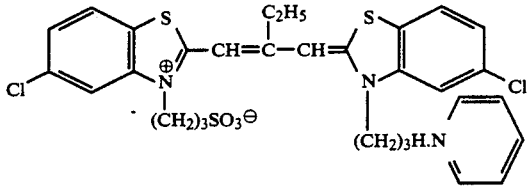

The preparation of Emulsion (II) for the third layer is described below.

To an aqueous gelatin solution (prepared by adding 20 g of gelatin, 0.30 g of potassium bromide, 6 g of sodium chloride and 0.015 g of Reagent A shown below to 730 ml of water and maintained at 60.0° C.) which was thoroughly stirred, were simultaneously added Solution (I) and Solution (II) each described below at the same flow rate over a period of 60 minutes. After the completion of the addition of Solution (I), Solution (III) of a sensitizing dye described below in methanol was added thereto. Thus, a dye adsorbed monodisperse cubic silver chlorobromide emulsion having an average grain size of 0.45 μm was prepared.

After being washed with water and desalted, 20 g of gelatin was added thereto and the pH and pAg were adjusted to 6.4 and 7.8, respectively. Then, the emulsion was subjected to chemical sensitization at 60.0° C. using 1.6 mg of triethylthiourea and 100 mg of 4-hydroxy-6-methyl-1,3,3a,7-tetraazaindene for a ripening time of 55 minutes. The yield of the emulsion was 635 g.

Reagent A

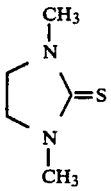

Sensitizing Dye C

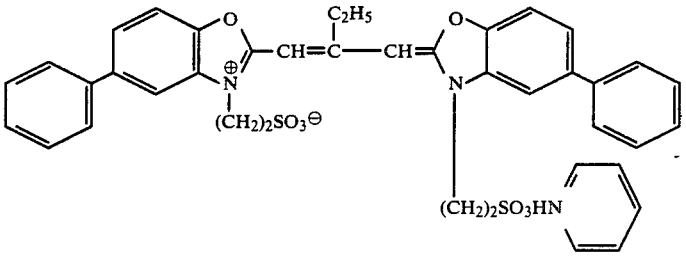

| | Solution (I) | Solution (II) | Solution (III) |
|---|---|---|---|
| $AgNO_3$ | 100 g | — | — |
| KBr | — | 56.0 g | — |
| NaCl | — | 7.2 g | — |
| Dye C | — | — | 0.23 mg |
| | Water to make 400 ml | Water to make 400 ml | Methanol to make 7 ml |

The preparation of Emulsion (III) for the fifth layer is described below.

To an aqueous gelatin solution (prepared by adding 30 g of gelatin, 3 g of potassium bromide and 0.5 g of $HO(CH_2)_2S(CH_2)_2S(CH_2)_2OH$ to 600 ml of water and maintained at 65° C.) which was thoroughly stirred, were simultaneously added Solution (I) and Solution (II) each described below over a period of 20 minutes, and then were simultaneously added Solution (III) and Solution (IV) each described below over a period of 30 minutes.

After being washed with water and desalted, 20 g of lime-processed ossein gelatin was added thereto and the pH and pAg were adjusted to 6.2 and 8.5, respectively. Then, the emulsion was subjected to optimum chemical sensitization using sodium thiosulfate, chloroauric acid and 4-hydroxy-6-methyl-1,3,3a,7-tetraazaindene. Thus, 600 g of a monodisperse octahedral silver iodobromide emulsion (III) having an average grain size of 0.50 μm was obtained.

| | Solution (I) | Solution (II) | Solution (III) | Solution (IV) |
|---|---|---|---|---|
| $AgNO_3$ | 30 g | — | 70 g | — |
| KBr | — | 19.0 g | — | 49 g |
| KI | — | 1.5 g | — | — |
| | Water to make | Water to make | Water to make | Water to make |

-continued

| | Solution (I) | Solution (II) | Solution (III) | Solution (IV) |
|---|---|---|---|---|
| | 200 ml | 200 ml | 400 ml | 400 ml |

The preparation of a gelatin dispersion of a dye providing compound is described below.

A mixture of 20 g of yellow dye providing Compound (1), 13.6 g of electron donor (ED-9), 10 g of tricyclohexyl phosphate and 57 ml of ethyl acetate were heated at about 60° C. to prepare a uniform solution. The resulting solution was mixed with stirring with 110 g of a 10% aqueous solution of lime-processed gelatin, 65 ml of water and 1.7 g of sodium dodecylbenzenesulfonate, and the mixture was then dispersed by means of a homogenizer at 10,000 rpm for 10 minutes. The dispersion thus obtained was designated a dispersion of yellow dye providing compound In the same manner for the dispersion of yellow dye providing compound as described above, dispersions of magenta and cyan dye providing compounds were prepared using magenta dye providing Compound (2) and cyan dye providing Compound (16), respectively.

Using these components, Multilayer Color Light-Sensitive Material 101 described in Table 1 below was prepared.

TABLE 1

Sixth Layer: Protective Layer

Gelatin (0.92 g/m$^2$), $Zn(OH)_2$ (0.46 g/m$^2$), Matting agent (silica) (0.03 g/m$^2$), Water-soluble polymer (1) (0.02 g/m$^2$), Surface active agent (1) (0.06 g/m$^2$), Surface active agent (2) (0.13 g/m$^2$), Hardening agent (1) (0.01 g/m$^2$).

Fifth Layer: Blue-Sensitive Layer

Emulsion (III) (0.35 g/m$^2$ as silver), Gelatin (0.48 g/m$^2$), Sensitizing dye (d) ($2.50\times10^{-3}$ g/m$^2$), Antifogging agent (1) ($5.00\times10^{-4}$ g/m$^2$), Yellow dye providing Compound (1) described above (0.41 g/m$^2$), Organic solvent having a high boiling point (1) (0.21 g/m$^2$), Electron Donor (ED-9) (0.28 g/m$^2$), Surface active agent (3) 0.05 g/m$^2$), Electron Transfer agent (1) (0.04 g/m$^2$), Hardening agent (1) (0.004 g/m$^2$), Water-soluble polymer (1) (0.01 g/m$^2$).

Fourth Layer: Interlayer

Gelatin (0.70 g/m$^2$), Surface active agent (1) (0.02 g/m$^2$), Surface active agent (3) (0.01 g/m$^2$), Surface active agent (4) (0.06 g/m$^2$), Water-soluble polymer (1) (0.02 g/m$^2$), Reducing agent (1) (0.19 g/m$^2$), Hardening agent (1) (0.008 g/m$^2$).

Third Layer: Green-Sensitive Layer

Emulsion (II) (0.21 g/m$^2$ as silver), Gelatin (0.30 g/m$^2$), Antifogging agent (2) ($6.4\times10^{-4}$), Magenta dye providing Compound (2) described above (0.32 g/m$^2$), Organic solvent having a high boiling point (1) (0.16 g/m$^2$), Electron donor (ED-9) (0.12 g/m$^2$), Surface active agent (3) (0.03 g/m$^2$), Electron transfer agent (1) (0.04 g/m$^2$), Hardening agent (1) (0.003 g/m$^2$), Water-soluble polymer (1) (0.01 g/m$^2$).

Second Layer: Interlayer

Gelatin (0.79 g/m$^2$), Matting agent (silica) (0.008 g/m$^2$), $Zn(OH)_2$ (0.46 g/m$^2$), Surface active agent (1) (0.05 g/m$^2$), Surface active agent (4) (0.10 g/m$^2$), Water-soluble polymer (1) (0.03 g/m$^2$), Hardening agent (1) (0.009 g/m$^2$)

First Layer: Red-Sensitive Layer

Emulsion (I) (0.21 g/m$^2$ as silver), Gelatin (0.30 g/m$^2$), Antifogging agent (2) ($6.4\times10^{-4}$), Cyan dye providing Compound (16) (0.28 g/m$^2$), Organic solvent having a high boiling point (1) (0.14 g/m$^2$), Electron donor (ED-9) (0.16 g/m$^2$), Surface active agent (3) (0.03 g/m$^2$), Electron transfer agent (1) (0.04 g/m$^2$), Hardening agent (1) (0.003 g/m$^2$), Water-soluble polymer (1) (0.01 g/m$^2$).

Support

Polyethylene terephthalate (thickness: 100 μm)

Backing Layer

Carbon black (0.44 g/m$^2$), Polyester (0.30 g/m$^2$), Polyvinyl chloride (0.30 g/m$^2$).

The additives shown in Table 1 above other than those described above are illustrated below.

Water-soluble polymer (1)

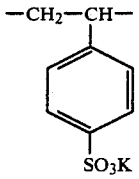

Polymer (1)

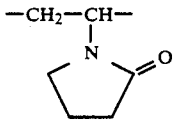

Surface active agent (1)
Aerosol® OT

Surface active agent (2)

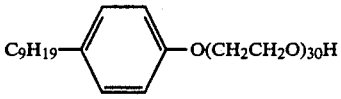

Surface active agent (3)

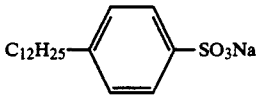

Surface active agent (4)

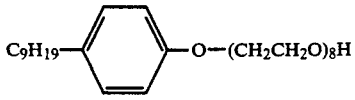

Hardening agent (1)
1,2-Bis(vinylsulfonylacetamido)ethane

Organic solvent having a high boiling point (1)
Tricyclohexyl phosphate

-continued

Sensitizing Dye (d)

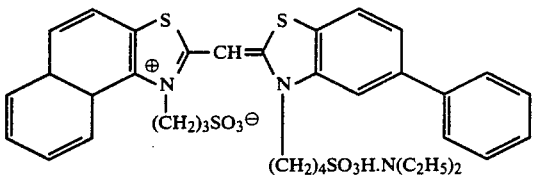

Electron transfer agent (1)

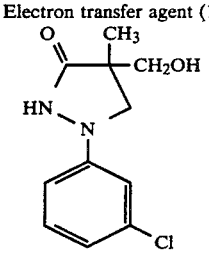

Antifogging agent (1)

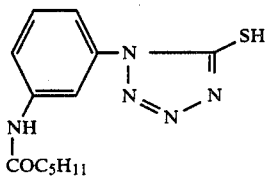

Antifogging agent (2)

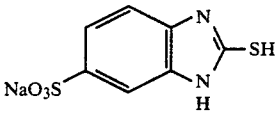

Reducing agent (1)

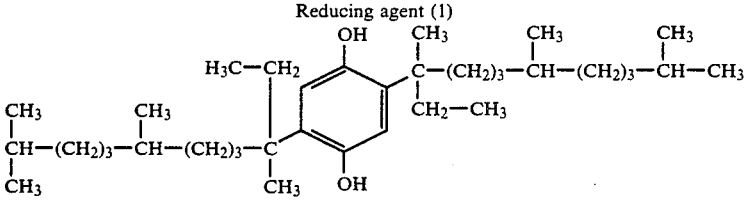

The preparation of a dye fixing material is described below.

Dye Fixing Material R-1 was prepared by coating each layer having the composition shown in Table 2 below on a polyethylene laminated paper support.

TABLE 2

Third Layer

Gelatin (0.05 g/m$^2$), Matting agent (silica) (0.02 g/m$^2$), Silicone oil (1) (0.04 g/m$^2$), Surface active agent (2) (0.001 g/m$^2$), Surface active agent (3) (0.02 g/m$^2$), Surface active agent (4) (0.10 g/m$^2$), Guanidine picolinate (0.45 g/m$^2$), Polymer (5) (0.24 g/m$^2$).

Second Layer

Mordant (6) (2.35 g/m$^2$), Polymer (7) (0.60 g/m$^2$), Gelatin (1.40 g/m$^2$), Polymer (5) (0.21 g/m$^2$), Organic solvent having a high boiling point (8) (1.40 g/m$^2$), Guanidine picolinate (1.80 g/m$^2$), Surface active agent (2) (0.02 g/m$^2$).

First Layer:

Gelatin (0.45 g/m$^2$), Surface active agent (4) (0.01 g/m$^2$), Polymer (5) (0.04 g/m$^2$), Hardening agent (9) (0.30 g/m$^2$).

Support:

Polyethylene laminated paper thickness: 170 μm).

First Backing Layer:

Gelatin (3.25 g/m$^2$), Hardening agent (9) (0.25 g/m$^2$).

Second Backing Layer:

Gelatin (0.44 g/m$^2$), Silicone oil (1) (0.08 g/m$^2$), Surface active agent (5) (0.002 g/m$^2$), Matting agent (10) (0.09 g/m$^2$).

The additives shown in Table 2 above are illustrated below.

Silicone oil (1)

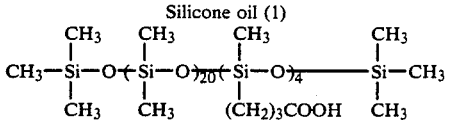

-continued

Surface active agent (2)
Aerosol ® OT

Surface active agent (3)

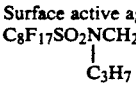

Surface active agent (4)

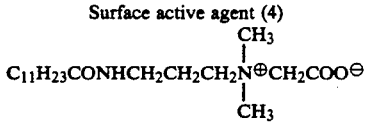

Surface active agent (5)

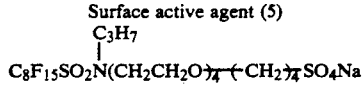

Polymer (5)
Copolymer of vinyl alcohol and sodium acrylate (75:25 in molar ratio)

Polymer (7)
Dextran (molecular weight: 70,000)

Mordant (6)

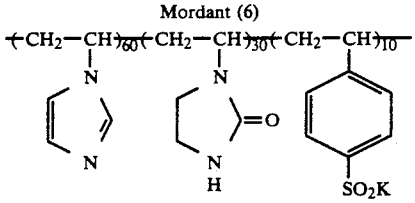

Organic solvent having a high boiling point (8)
Reofos ® 95 manufactured by Ajinomoto Co., Ltd.

Hardening agent (9)

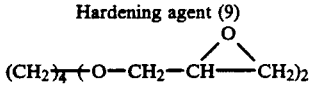

Matting agent (10)
Benzoguanamine resin (average particle size: 15 μm)

Color Light-Sensitive Materials 102 to 105 were prepared in the same manner as described for Color Light-Sensitive Material 101, except for using the equimolar amount of electron transfer agents (X-1), (X-4), (X-b 14) and (X-22) according to the present invention in place of Electron Transfer agent (1) employed in Color Light-Sensitive Material 101, respectively.

Each of the multilayer color light-sensitive materials as described above was exposed to light through a color separation filter of B, G and R and a grey filter, the density of each of which continuously changed, for 1/10 second at 5,000 lux using a tungsten lamp. On the emulsion side surface of the exposed light-sensitive material transported at a line speed of 20 mm/sec. was supplied water at a rate of 15 ml/m$^2$ by a wire bar and then immediately it was superimposed on the dye fixing material in such a manner that their coated layers were in contact with each other. These materials were heated for 15 seconds using a heat roller which had been so adjusted that the temperature of the layers containing absorbed water became 85° C.

Then, the dye fixing material was peeled apart from the light-sensitive material, whereupon sharp blue, green, red and grey images were obtained in the dye fixing material corresponding to the color separation filter of B, G and R and the grey filter, respectively.

The maximum density ($D_{max}$) and the minimum density ($D_{min}$) of each of cyan, magenta and yellow colors at the grey area were measured.

The results thus-obtained are shown in Table 3 below.

TABLE 3

| Light-Sensitive Material | ETA | Maximum Density | | | Minimum Density | | |
|---|---|---|---|---|---|---|---|
| | | Cyan | Magenta | Yellow | Cyan | Magenta | Yellow |
| 101 | — | 2.05 | 2.23 | 2.01 | 0.15 | 0.16 | 0.18 |
| 102 | (X-1) | 2.04 | 2.22 | 2.02 | 0.14 | 0.16 | 0.18 |
| 103 | (X-4) | 2.06 | 2.22 | 2.02 | 0.15 | 0.16 | 0.17 |
| 104 | (X-14) | 2.06 | 2.21 | 2.03 | 0.14 | 0.15 | 0.18 |
| 105 | (X-22) | 2.05 | 2.22 | 2.02 | 0.14 | 0.16 | 0.18 |

Further, the multilayer color light-sensitive material was preserved under conditions of 40° C. and 70% RH for one week and thereafter exposed to light and subjected to development processing in the same manner as described above. The maximum density ($D_{max}$) and the minimum density ($D_{min}$) of each of cyan, magenta and yellow colors at the grey area were measured.

The results are shown in Table 4 below.

TABLE 4

| Light-Sensitive Material | ETA | Maximum Density | | | Minimum Density | | |
|---|---|---|---|---|---|---|---|
| | | Cyan | Magenta | Yellow | Cyan | Magenta | Yellow |
| 101 | — | 2.05 | 2.21 | 2.00 | 0.33 | 0.38 | 0.42 |
| 102 | (X-1) | 2.05 | 2.21 | 2.01 | 0.25 | 0.25 | 0.27 |
| 103 | (X-4) | 2.05 | 2.20 | 2.01 | 0.24 | 0.25 | 0.28 |
| 104 | (X-14) | 2.05 | 2.22 | 2.04 | 0.23 | 0.24 | 0.27 |
| 105 | (X-22) | 2.04 | 2.21 | 2.03 | 0.24 | 0.24 | 0.27 |

From the results shown in Tables 3 and 4 it is apparent that Color Light-Sensitive Materials 102 to 105 containing the ETA according to the present invention were excellent, since they reduced staining after preservation in comparison with Color Light-Sensitive Material 101 for comparison.

EXAMPLE 2

Multilayer Color Light-Sensitive Material 201 described in Table 5 below was prepared using the same emulsions as used in Color Light-Sensitive Material 101 of Example 1, dye providing compounds, electron donor, and electron transfer agent. The additives used were the same as those described in Color Light-Sensitive material 101, unless otherwise indicated.

An organic silver salt emulsion was prepared in the manner described below.

20 g of gelatin and 5.9 g of 4-acetylaminophenyl propiolic acid were dissolved in 1,000 ml of a 0.1% aqueous sodium hydroxide solution and 200 ml of ethanol. The solution thus prepared was then stirred with the temperature thereof kept at 40° C. A solution of 4.5 g of silver nitrate dissolved in 200 ml of water was added to the solution for 5 minutes. The excess salts were then removed by a flocculation method. The pH of the dispersion was adjusted to 6.3 to obtain 300 g of the dispersion of the organic silver salt.

Further, antifogging agent precursor (1) described below was added in an amount of 0.2 molar time the dye providing compound and dispersed together with the dye providing compound and the electron donor in the same manner as described in Example 1.

TABLE 5

Sixth Layer: Protective Layer

Gelatin (0.91 g/m$^2$), matting agent (silica)(0.03 g/m$^2$), Surface active agent (1) (0.06 g/m$^2$), Surface active agent (2) (0.13 g/m$^2$), Hardening agent (1) (0.01 g/m$^2$), Base precursor (1) (0.30).

Fifth Layer: Blue-Sensitive Layer

Emulsion (III) (0.30 g/m$^2$ as silver), Organic silver salt emulsion (0.25 g/m$^2$ as silver), Gelatin (1.00 g/m$^2$), Antifogging agent precursor (1) (0.07 g/m$^2$), Yellow dye providing Compound (1) (0.50 g/m$^2$), Organic solvent having a high boiling point (1) (0.75 g/m$^2$), Electron donor (ED-6) (0.35 g/m$^2$), Surface active agent (3) (0.05 g/m$^2$), Electron transfer agent (2) (0.04 g/m$^2$), Thermal solvent (1) (0.20 g/m$^2$), Hardening agent (1) (0.01 g/m$^2$), Base precursor (1) (0.27 g/m$^2$), Water-soluble polymer (1) (0.02 g/m$^2$).

Fourth Layer: Interlayer

Gelatin (0.75 g/m$^2$), Reducing agent (2) (0.24 g/m$^2$), Surface active agent (1) (0.02 g/m$^2$), Surface active agent (4) (0.07 g/m$^2$), Water-soluble polymer (1) (0.02 g/m$^2$), Hardening agent (1) (0.01 g/m$^2$), Base precursor (1) (0.25 g/m$^2$).

Third Layer: Green-Sensitive Layer

Emulsion (II) (0.20 g/m$^2$ as silver), Organic silver salt emulsion (0.20 g/m$^2$ as silver), Gelatin (0.85 g/m$^2$), Antifogging agent precursor (1) (0.04 g/m$^2$), Magenta dye providing Compound (2) (0.37 g/m$^2$), Organic solvent having a high boiling point (1) (0.55 g/m$^2$), Electron donor (ED-6) (0.20 g/m$^2$), Surface active agent (3) (0.04 g/m$^2$), Electron transfer agent (2) (0.04 g/m$^2$), Thermal solvent (1) (0.16 g/m$^2$), Hardening agent (1) (0.01 g/m$^2$), Base precursor (1) (0.25 g/m$^2$), Water-soluble polymer (1) (0.02 g/m$^2$).

Second Layer: Interlayer

Gelatin (0.80 g/m$^2$), Reducing agent (2) (0.24 g/m$^2$), Surface active agent (1) (0.06 g/m$^2$), Surface active agent (4) (0.10 g/m$^2$), Water-soluble polymer (1) (0.03 g/m$^2$), Base precursor (1) (0.25 g/m$^2$), Hardening agent (1) (0.01 g/m$^2$).

First Layer: Red-Sensitive Layer

Emulsion (I) (0.20 g/m$^2$ as silver), Organic silver salt emulsion (0.20 g/m$^2$ as silver), Gelatin (0.85 g/m$^2$), Antifogging agent precursor (1) (0.04 g/m$^2$), Thermal solvent (1) (0.16 g/m$^2$), Base precursor (1) (0.25 g/m$^2$), Cyan dye providing Compound (9) (0.40 g/m$^2$), Organic solvent having a high boiling point (1) (0.60 g/m$^2$), Electron donor (ED-6) (0.20 g/m$^2$), Surface active agent (3) (0.04 g/m$^2$), Electron transfer agent (2) (0.04 g/m$^2$), Hardening agent (1) (0.01 g/m$^2$), Water-soluble polymer (1) (0.02 g/m$^2$).

Support

Polyethylene terephthalate (thickness: 100 μm).

Backing Layer

Carbon black (0.44 g/m$^2$), Polyester (0.30 g/m$^2$), Polyvinyl chloride (0.30 g/m$^2$)

The additive shown in Table 5 above other than those described hereinbefore are illustrated below.

Antifogging agent Precursor (1)

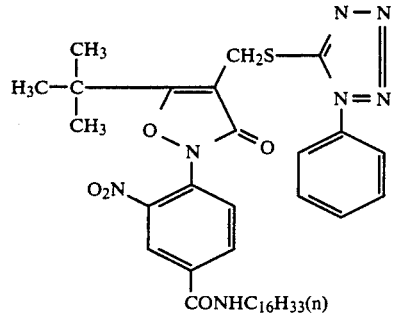

Thermal solvent (1)
Benzenesulfonamide

Base precursor (1)
Guanidium 4-chlorophenylsulfonylacetate

Reducing agent (2)

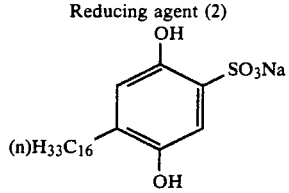

Electron transfer agent (2)

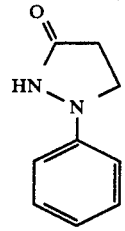

The preparation of Dye Fixing Material R-2 is described hereinafter.

10 g of poly(methyl acrylate-co-N,N,N-trimethyl-N-vinylbenzylammonium chloride) (ratio of methyl acrylate to vinylbenzylammonium chloride: 1/1) was dissolved in 200 ml of water. The solution was uniformly mixed with 100 g of a 10% aqueous solution of lime-processed gelatin and a hardening agent was added thereto. The admixture was then uniformly coated on a paper support laminated with polyethylene comprising titanium dioxide dispersed therein to a wet layer thickness of 90 μm, whereby Dye Fixing Material R-2 was obtained.

Color Light-Sensitive Materials 202 to 205 were prepared in the same manner as described for Color Light-Sensitive Material 101, except for using the equimolar amount of electron transfer agents (X-2), (X-6), (X-15) and (X-16) according to the present invention in place of Electron transfer agent (2) employed in Color Light-Sensitive Material 201, respectively.

The color light-sensitive material was exposed in the same manner as described in Example 1 and then uniformly heated for 30 seconds on a heat block which had been heated at 140° C.

On the coated layer side surface of Dye Fixing Material R-2 was supplied water in an amount of 20 ml per $m^2$ and then the light-sensitive material after heat treatment was superimposed on the fixing material in such a manner that their coated layers were in contact with each other. There materials were passed through a laminater heated at 80° C. at a line speed of 12 mm/sec.

Then, the dye fixing material was peeled apart from the light-sensitive material and a positive image having a good S/N ratio was obtained on the dye fixing material.

The maximum density ($D_{max}$) and the minimum density ($D_{min}$) of each of cyan, magenta and yellow colors at the grey area were measured.

The results thus-obtained are shown in Table 6 below.

TABLE 6

| Light-Sensitive Material | ETA | Maximum Density | | | Minimum Density | | |
|---|---|---|---|---|---|---|---|
| | | Cyan | Magenta | Yellow | Cyan | Magenta | Yellow |
| 201 | — | 2.04 | 2.10 | 2.00 | 0.19 | 0.19 | 0.20 |
| 202 | (X-2) | 2.03 | 2.09 | 2.01 | 0.18 | 0.19 | 0.20 |
| 203 | (X-6) | 2.03 | 2.08 | 2.00 | 0.18 | 0.18 | 0.18 |
| 204 | (X-15) | 2.02 | 2.09 | 2.00 | 0.19 | 0.18 | 0.19 |
| 205 | (X-16) | 2.03 | 2.10 | 2.01 | 0.19 | 0.19 | 0.19 |

Further, Color Light-Sensitive Materials 201 to 206 were preserved under conditions of 40° C. and 70% RH for one week and thereafter exposed to light and subjected to development processing in the same manner as described above. The maximum density ($D_{max}$) and the minimum density ($D_{min}$) of each of cyan, magenta and yellow colors at the grey area were measured.

The results are shown in Table 7 below.

TABLE 7

| Light-Sensitive Material | ETA | Maximum Density | | | Minimum Density | | |
|---|---|---|---|---|---|---|---|
| | | Cyan | Magenta | Yellow | Cyan | Magenta | Yellow |
| 201 | — | 2.05 | 2.10 | 2.00 | 0.40 | 0.42 | 0.47 |
| 202 | (X-2) | 2.04 | 2.10 | 2.00 | 0.26 | 0.27 | 0.28 |
| 203 | (X-6) | 2.04 | 2.10 | 2.00 | 0.27 | 0.27 | 0.29 |
| 204 | (X-15) | 2.03 | 2.09 | 2.01 | 0.27 | 0.28 | 0.28 |
| 205 | (X-16) | 2.04 | 2.09 | 2.00 | 0.26 | 0.28 | 0.29 |

From the results shown in Tables 6 and 7 it is apparent that Color Light-Sensitive Materials 202 to 205 containing the ETA according to the present invention were excellent in reducing staining after the preservation as compared with Color Light-Sensitive Material 201 for comparison.

While the invention has been described in detail and with reference to specific embodiments thereof, it will be apparent to one skilled in the art that various changes and modifications can be made therein without departing from the spirit and scope thereof.

What is claimed is:

1. A heat-developable color light sensitive material comprising a support having thereon at least a light-sensitive silver halide, a binder, a non-diffusible compound capable of releasing a diffusible dye upon reduction, an electron donor compound or an electron donor precursor, and an electron transfer agent, said electron transfer agent being represented by formula (I):

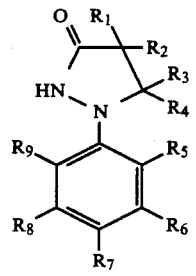

(I)

wherein $R_1$, $R_2$, $R_3$ and $R_4$, which may be the same or different, each represents hydrogen, a substituted or unsubstituted alkyl group, or a substituted or unsubstituted aryl group; $R_5$ represents a halogen atom, a hydroxyl group, a substituted or unsubstituted alkyl group, or a substituted or unsubstituted alkoxy group; at least one of $R_6$, $R_7$, and $R_8$, which may be the same or different, represents an electron donative group which is a member selected from the group consisting of an alkyl group, an alkoxy group and an amino group, and the others represent a hydrogen atom; and R9 represents a hydrogen atom.

2. The heat-developable color light-sensitive material as claimed in claim 1, wherein each said substituted group represented by $R_1$, $R_2$, $R_3$ and $R_4$ is substituted with at least one substituent selected from the group consisting of a halogen atom, a hydroxyl group, a substituted or unsubstituted alkoxy group, a substituted or unsubstituted alkoxycarbonyl group, a substituted or unsubstituted acyloxy group, a substituted or unsubstituted amino group, a substituted or unsubstituted carbamoyl group, and a substituted or unsubstituted acylamino group.

3. The heat-developable color light-sensitive material as claimed in claim 1, wherein $R_5$ represents a methyl group or a methoxy group.

4. The heat-developable color light-sensitive material as claimed in claim 1, wherein each of $R_6$, $R_7$ and $R_8$ represents an alkyl group, an alkoxy group, or an amino group.

5. The heat-developable color light-sensitive material as claimed in claim 1, further comprising a second support having thereon at least one dye-fixing layer comprising a mordant and a binder capable of receiving said diffusible dye after its release.

6. The heat-developable color light-sensitive material as claimed in claim 1, wherein said light-sensitive silver halide emulsion layer comprises said electron transfer agent.

7. The heat-developable color light-sensitive material as claimed in claim 6, wherein said silver halide emulsion layer further comprises said electron donor compound and said non-diffusible compound capable of releasing a diffusible dye upon reduction.

8. The heat-developable color light-sensitive material as claimed in claim 1, wherein said non-diffusible compound capable of releasing a diffusible dye upon reduction is represented by formula (C-I):

$$\text{PWR}(\text{Time})_t\text{Dye} \qquad \text{(C-I)}$$

wherein PWR represents a group capable of releasing —Time)$_t$Dye upon reduction; Time represents a group capable of releasing by a reaction after —Time)$_t$Dye is released from PWR; t is 0 or 1; and Dye represents a dye or a dye precursor.

9. The heat-developable color light-sensitive material as claimed in claim 8, wherein said compound represented by formula (C-I) is represented by formula (C-II):

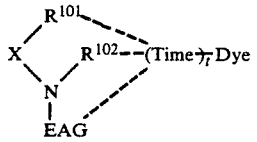

(C-II)

wherein Time, Dye and t each is as defined in formula (C-I); X represents oxygen, sulfur or —N($R^{103}$)—; EAG represents a group capable of receiving an electron from a reducing substance; $R^{101}$, $R^{102}$ and $R^{103}$, which may be the same or different, each represents a simple bond, an alkyl group, an aralkyl group, an alkenyl group, an alkynyl group, an aryl group, a heterocyclic group, an acyl group, a sulfonyl group, a carbamoyl group or a sulfamoyl group, and any of $R^{101}$, $R^{102}$ and $R^{103}$ may be linked to form a 5-membered to 8-membered ring; provided that at least one of $R^{101}$, $R^{102}$ and EAG is bonded to —Time)$_t$Dye.

10. The heat-developable color light-sensitive material as claimed in claim 9, wherein $R^{101}$ and $R^{103}$ each represents a substituted or unsubstituted alkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group, or a substituted or unsubstituted sulfonyl group; $R^{102}$ represents a substituted or unsubstituted acyl group or a substituted or unsubstituted sulfonyl group; and X represents oxygen.

11. The heat-developable color light-sensitive material as claimed in claim 9, wherein said compound represented by formula (C-II) is represented by formula (C-III):

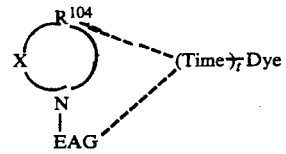

(C-III)

wherein each of X, EAG, Time, t, and Dye has the same definition as in formula (C-II); $R^{104}$ represents an atomic group necessary for forming a 5-membered to 8-membered monocyclic or condensed heterocyclic ring; and at least one of $R^{104}$ and EAG is bonded to —Time)$_t$Dye.

12. The heat-developable color light-sensitive material as claimed in claim 9, wherein EAG is represented by formula (A):

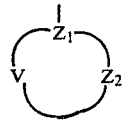

(A)

wherein $Z_1$ represents

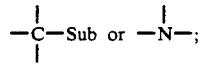

Vn represents an atomic group necessary to form a 3-membered to 8-membered aromatic ring together with $Z_1$ and $Z_2$; n represents an integer from 3 to 8; $V_n$ means the following:

$V_3$: —$Z_3$—, $V_4$: —$Z_3$—$Z_4$—, $V_5$: —$Z_3$—$Z_4$—$Z_5$—, $V_6$: —$Z_3$—$Z_4$—$Z_5$—$Z_6$—, $V_7$: —$Z_3$—$Z_4$—$Z_5$—$Z_6$—$Z_7$—, and $V_8$: —$Z_3$—$Z_4$—$Z_5$—$Z_6$—$Z_7$—$Z_8$—;

$Z_2$ to $Z_8$ each represents

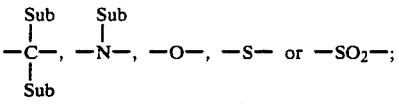

and Sub represents a simple bond, hydrogen or a substituent, provided that the total of the Hammett's substituent constants of said Sub groups is at least +0.50.

13. The heat-developable color light-sensitive material as claimed in claim 12, wherein EAG represents an aryl group substituted with at least one electron attractive group or a heterocyclic group substituted with at least one electron attractive group.

14. The heat-developable color light-sensitive material as claimed in claim 8, wherein Dye represents an azo dye, an azomethine dye, an anthraquinone dye, a naphthoquinone dye, a styryl dye, a nitro dye, a quinoline dye, a carbonyl dye, or a phthalocyanine dye.

15. The heat-developable color light-sensitive material as claimed in claim 1, wherein said non-diffusible compound capable of releasing a diffusible dye is present in an amount of from 0.05 to 5 mmol/m$^2$ of said layer.

16. The heat-developable color light-sensitive material as claimed in claim 1, wherein said electron donor compound is represented by formulae (C) or (D):

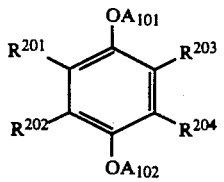

(C)

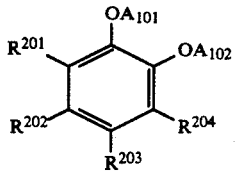

(D)

wherein $A_{101}$ and $A_{102}$, which may be the same or different, each represents hydrogen or a protective group for a phenolic hydroxyl group capable of being removed by a nucleophilic reagent; and $R^{201}$, $R^{202}$, $R^{203}$ and $R^{204}$, which may be the same or different, each represents hydrogen, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group, provided that $R^{201}$, $R^{202}$, $R^{203}$ and $R^{204}$ contain a total of at least 8 carbon atoms, and adjacent $A_{101}$, $A_{102}$, $R^{201}$, $R^{202}$, $R^{203}$ and $R^{204}$ groups may be linked to form a saturated or unsaturated ring.

17. The heat-developable color light-sensitive material as claimed in claim 1, wherein said electron donor compound or a precursor thereof is present in an amount of from 0.01 to 50 mol per mol of said non-diffusible compound capable of releasing a diffusible dye, and said electron donor is present in an amount of from 0.001 to 5 mol per mol of said silver halide.

18. The heat-developable color light-sensitive material as claimed in claim 1, wherein said silver halide is a surface latent image silver halide and is present in an amount of from 1 mg/m$^2$ to 10 g/m$^2$ calculated as silver in said light-sensitive silver halide emulsion layer.

19. The heat-developable color light-sensitive material as claimed in claim 1, wherein said light-sensitive silver halide emulsion further comprises from 0.01 to 10 mol of an organic silver salt per mol of said light-sensitive silver halide, and the total amount of silver in said light-sensitive silver halide and said organic silver salt is from 50 mg to 10 g/m$^2$ of said silver halide emulsion layer.

* * * * *